US005162008A

United States Patent [19]

Steiner et al.

[11] Patent Number: 5,162,008

[45] Date of Patent: Nov. 10, 1992

[54] METHOD AND APPARATUS FOR STRETCHING INTERCHANGEABLE TENSION MASKS IN COLOR CATHODE RAY TUBES

[75] Inventors: Johann Steiner, Des Plaines; Paul Strauss, Chicago, both of Ill.

[73] Assignee: Zenith Electronics Corporation

[21] Appl. No.: 717,240

[22] Filed: Jun. 18, 1991

Related U.S. Application Data

[60] Continuation-in-part of Ser. No. 710,738, May 29, 1991, which is a continuation-in-part of Ser. No. 562,523, Aug. 3, 1990, Pat. No. 5,059,147, which is a division of Ser. No. 370,204, Jun. 22, 1989, Pat. No. 4,923,280, which is a continuation-in-part of Ser. No. 223,475, Jul. 22, 1988, Pat. No. 4,902,257.

[51] Int. Cl.[5] ..... H01J 9/00

[52] U.S. Cl. ..... 445/30; 445/68; 72/296; 101/127.1

[58] Field of Search ..... 445/30, 68, 64, 4, 3; 72/302, 305, 296; 254/133 R, 134; 101/127.1; 269/266

[56] References Cited

U.S. PATENT DOCUMENTS

| | | | |
|---|---|---|---|
| 2,824,594 | 2/1958 | Gray, I | 72/8 |
| 3,299,688 | 1/1967 | Gray, II | 72/296 |
| 3,579,718 | 5/1971 | Miller et al. | 425/182 X |
| 4,041,861 | 8/1977 | Alter | 101/127.1 |
| 4,753,379 | 6/1988 | Blasberg et al. | 72/378 X |
| 4,902,257 | 2/1990 | Adler et al. | 445/4 |

*Primary Examiner*—Kenneth J. Ramsey

[57] ABSTRACT

An apparatus and method for differentially stretching a flat tension mask to register apertures in the mask with an undedicated screen on a CRT faceplate. Stretching is accomplished biaxially on the mask with a plurality of separate clamping elements along all four sides of the mask. Various methods and means are disclosed for applying a fixed ratio of forces to the clamps to maintain strain in the mask substantially uniform across the entire mask, such as a "wiffle tree" linkage and selected spring rate springs. Growth of the mask during stretching is accommodated by allowing the clamps to move laterally or perpendicular to the stretching forces. Fragile slit aperture masks are stretched with clamps having tangential component stretching forces. Individual and/or groups of clamps can be controlled independently of others to correct for localized mask or screen defects. The clamps move in unison toward the mask to a clamp engagement position where they are precisely aligned in a starting position. With the mask precisely located and held, the clamps are engaged. The clamps and mask are then released by their aligning devices and stretching begins.

30 Claims, 21 Drawing Sheets

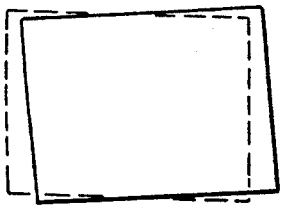
FIG. 14a
FIG. 14
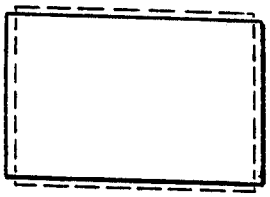
FIG. 14b
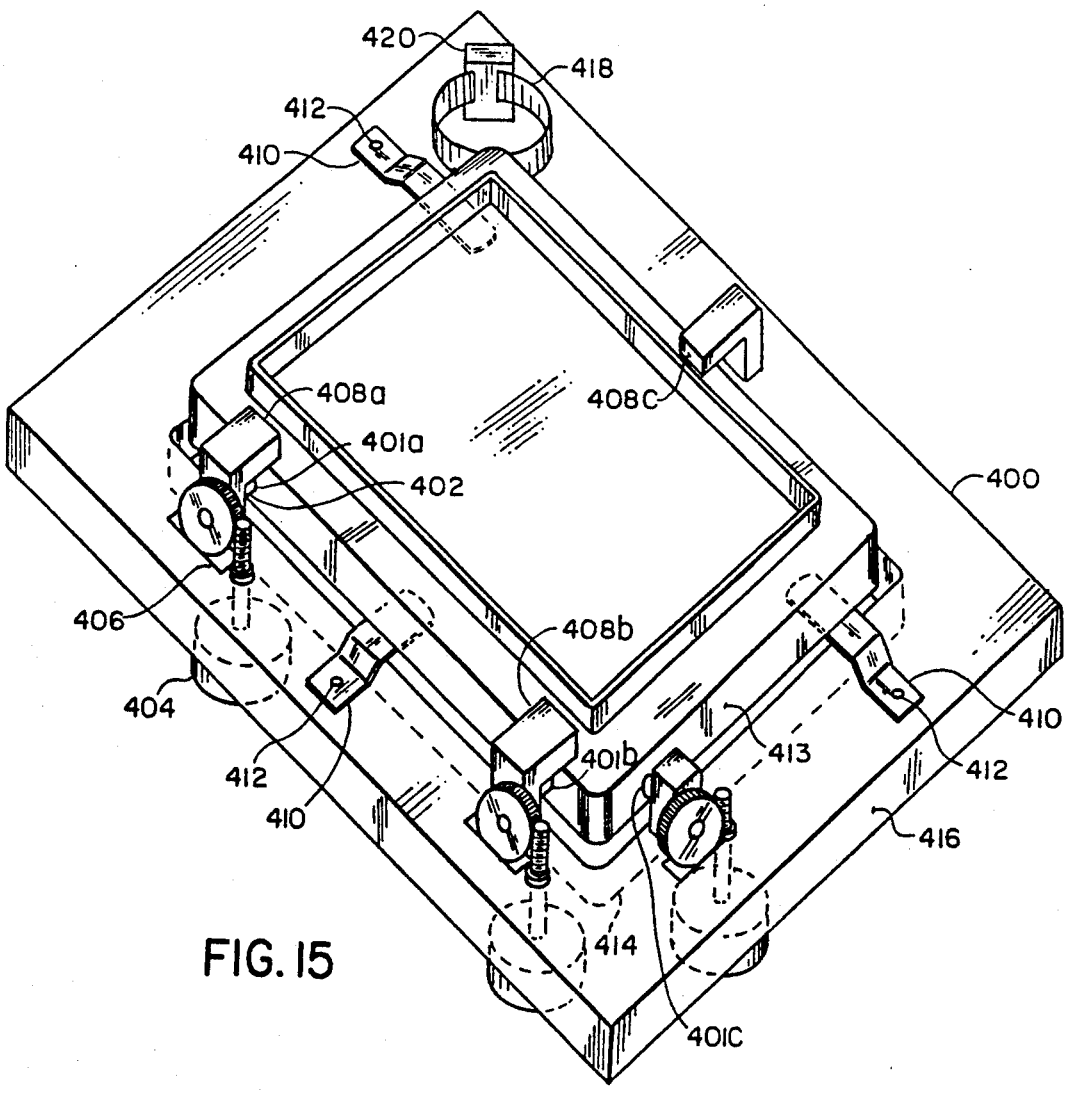
FIG. 15

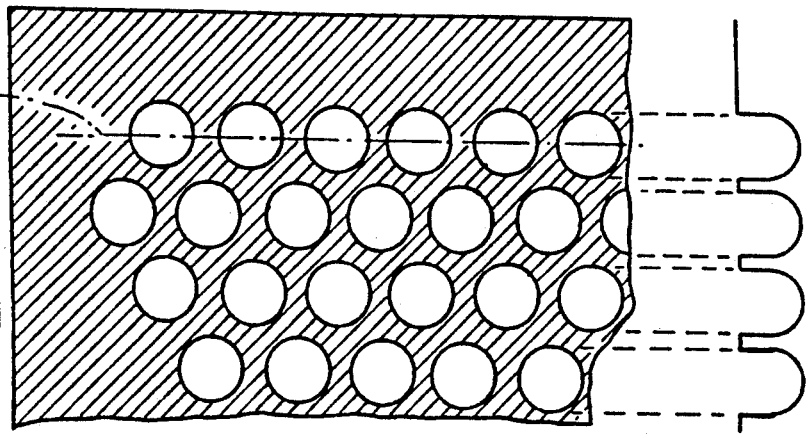
FIG.18a
FIG.18c
FIG. 18
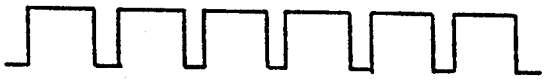
FIG. 18b
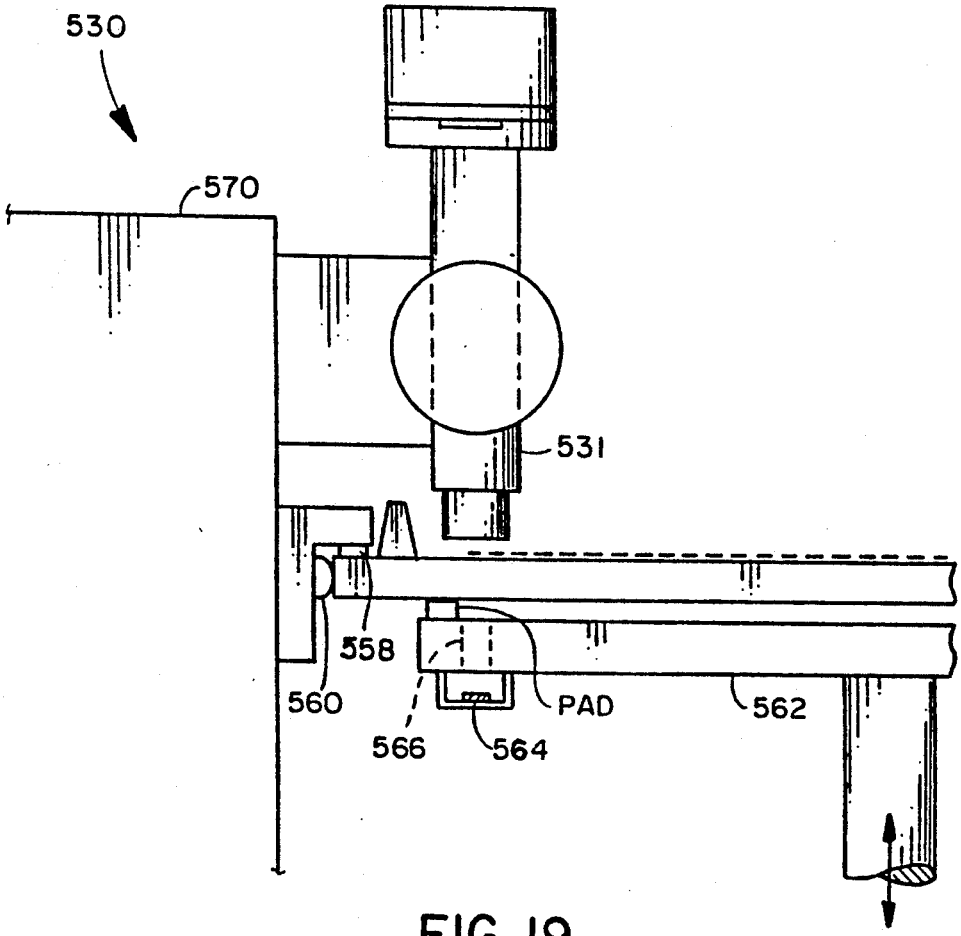
FIG. 19

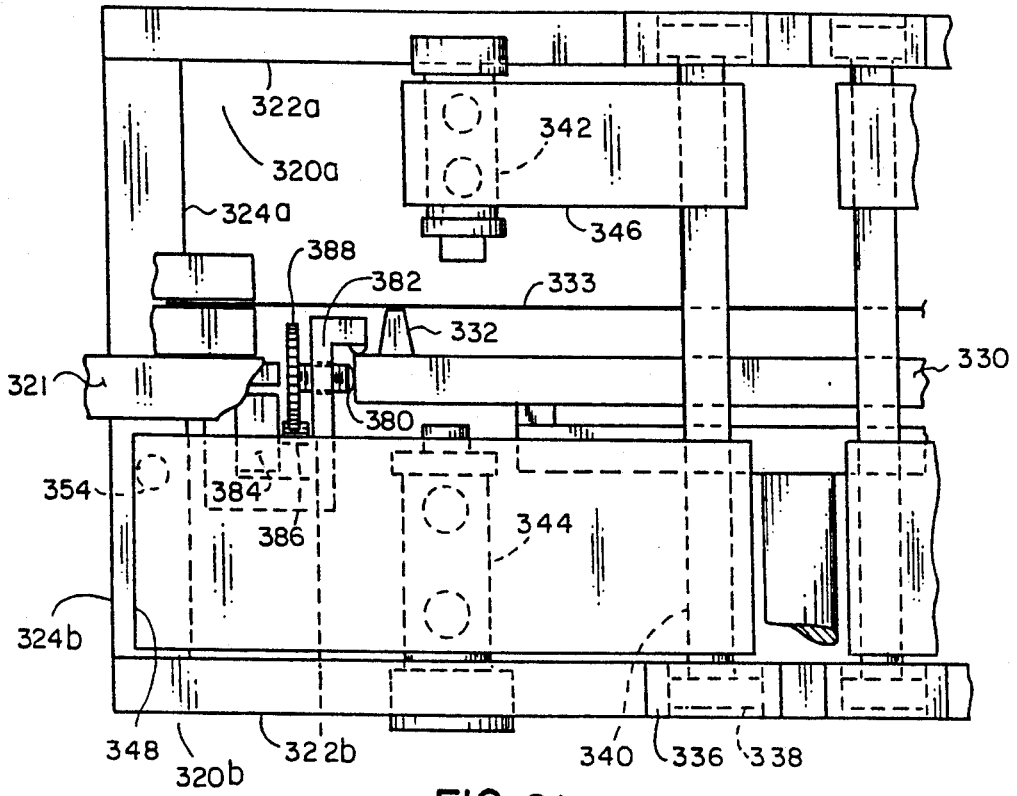
FIG. 21a
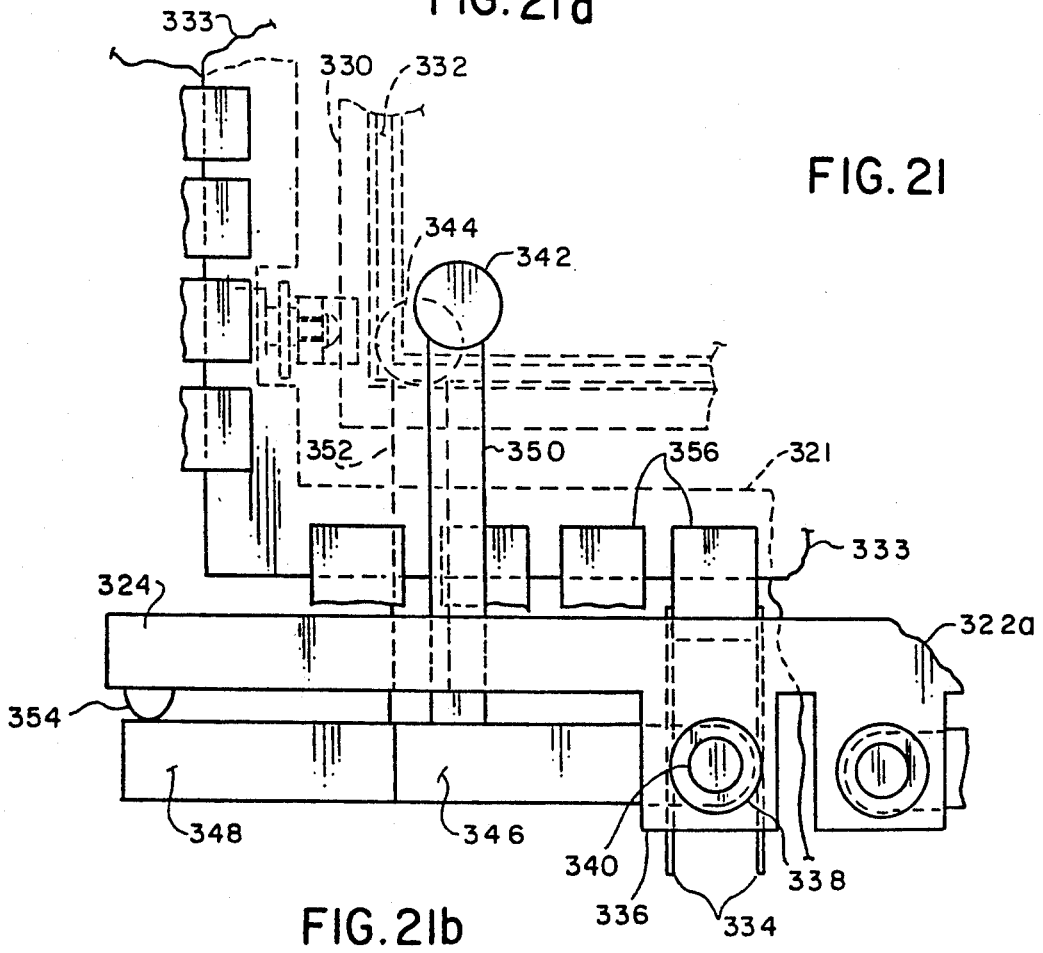
FIG. 21
FIG. 21b

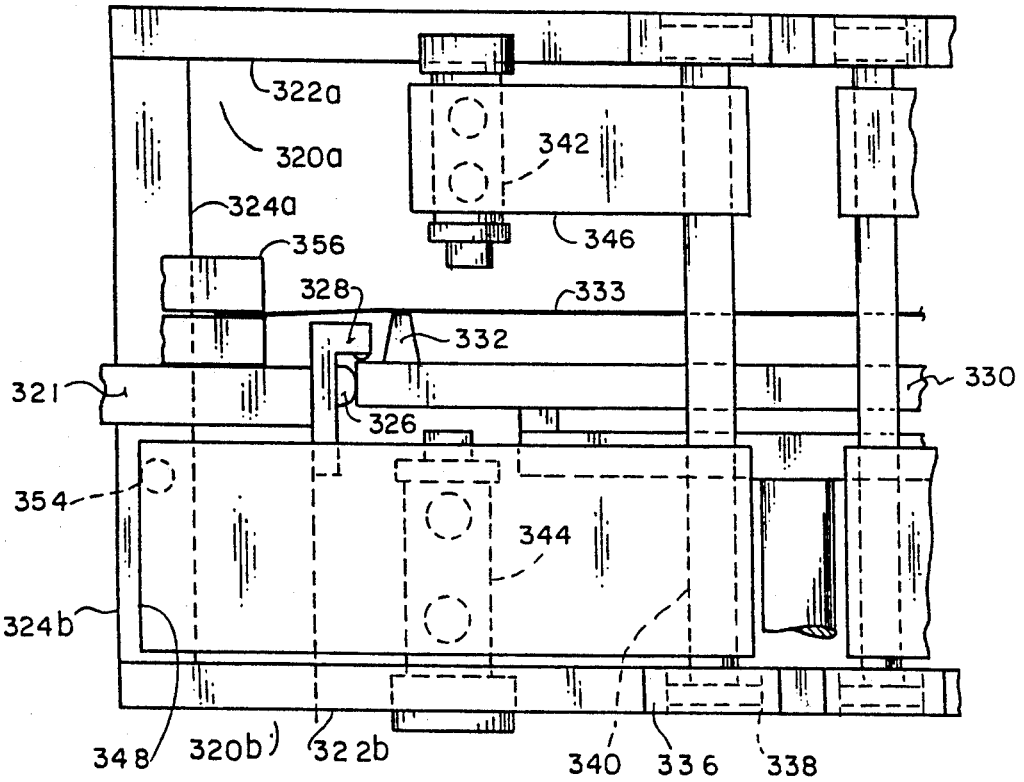
FIG. 23a
FIG. 23
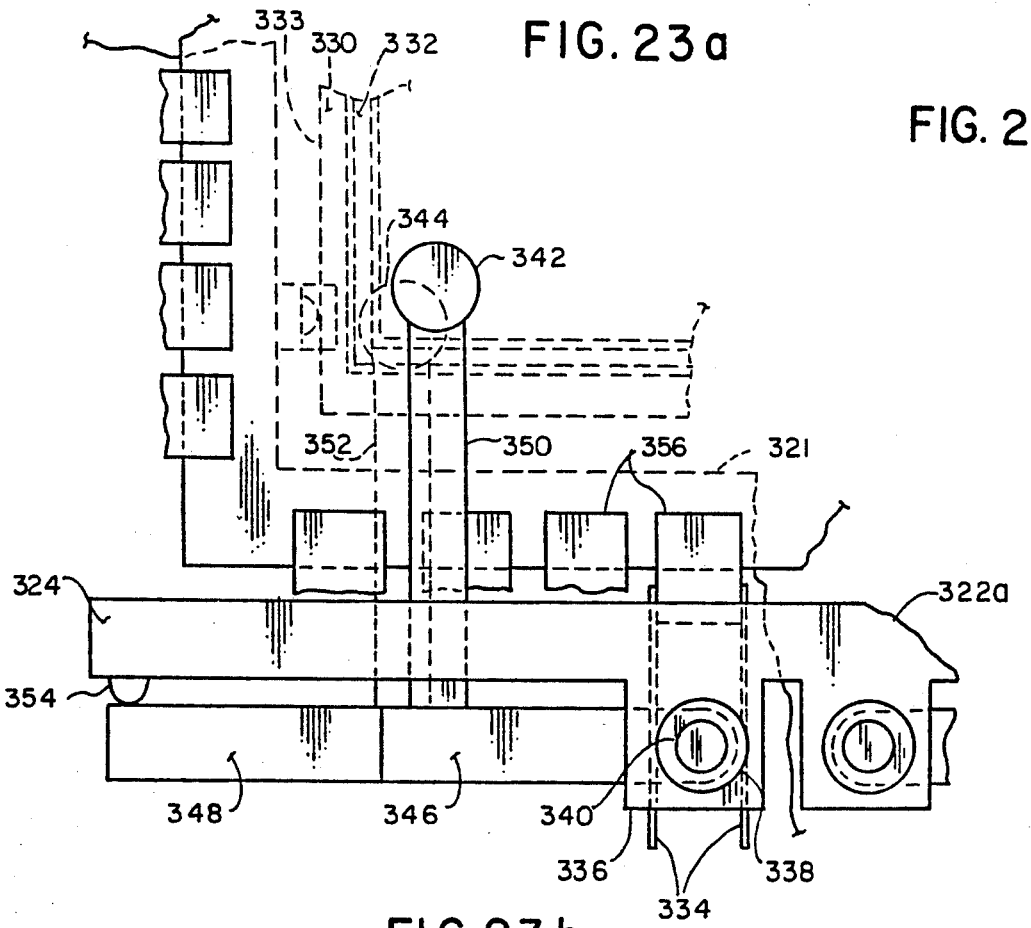
FIG. 23b

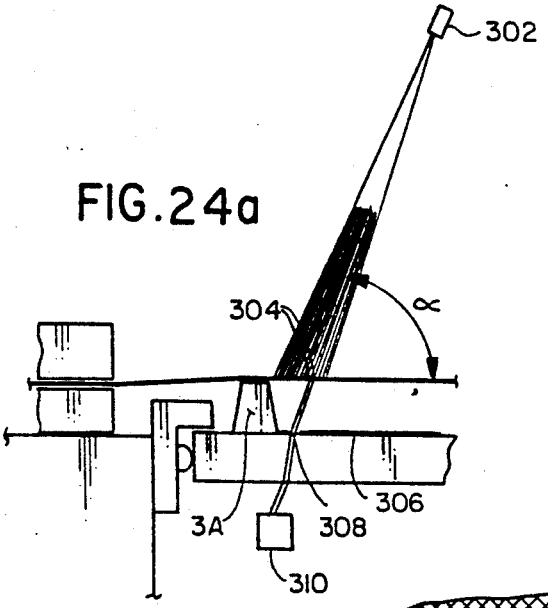
FIG.24a
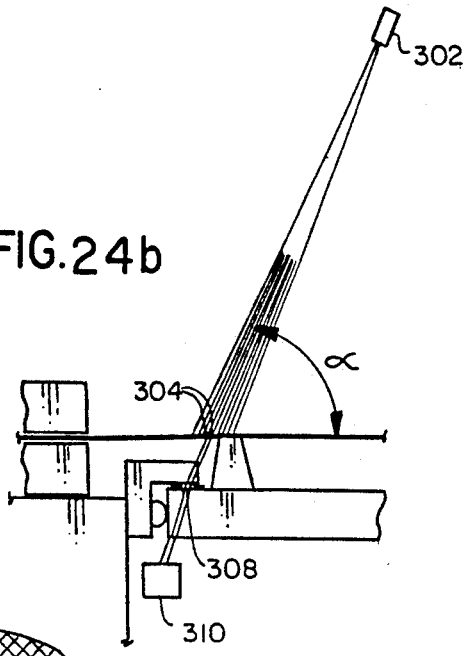
FIG.24b
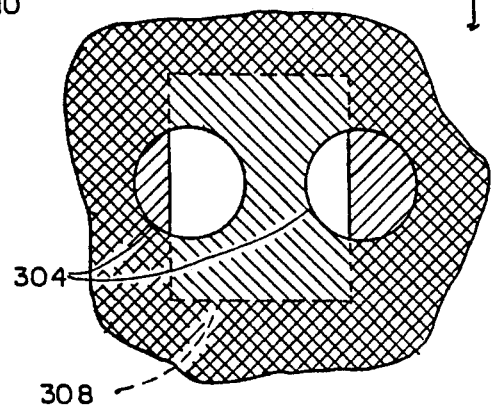
FIG.24c
FIG. 24
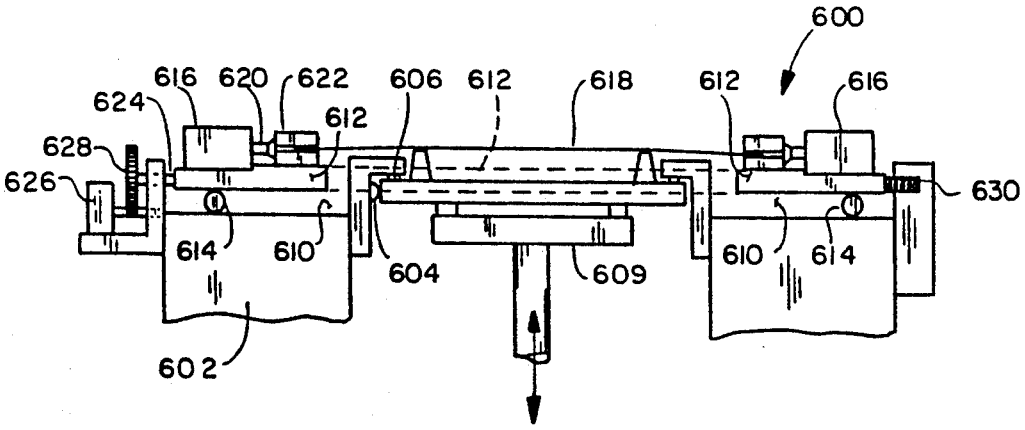
FIG. 25

METHOD AND APPARATUS FOR STRETCHING INTERCHANGEABLE TENSION MASKS IN COLOR CATHODE RAY TUBES

RELATED APPLICATIONS

This application is a continuation-in-part of our U.S. Ser. No. 710,738 filed May 29, 1991, which in turn is a continuation-in-part of U.S. Ser. No. 562,523 filed on Aug. 3, 1990, now U.S. Pat. No. 5,059,147, entitled "METHOD AND APPARATUS FOR MAKING FLAT TENSION MASK COLOR CATHODE RAY TUBES", which is a divisional application of our U.S. patent application Ser. No. 370,204 filed on Jun. 22, 1989, now U.S. Pat. No. 4,923,280, which in turn is a continuation-in-part of our U.S. patent application, U.S. Ser. No. 223,475 filed on Jul. 22, 1988, now U.S. Pat. No. 4,902,257 issued Feb. 20, 1990. This application is also related to the Robert Adler, et al., U.S. patent application Ser. No. 07/605,047, filed Oct. 29, 1990, entitled "MECHANICALLY INDEXED MASK STRETCHING", assigned to the assignee of the present invention.

BACKGROUND OF THE INVENTION

The invention applies to the manufacture of flat tension mask color cathode ray tubes. More specifically, the invention provides means for achieving registration of the aperture patterns of flat tension shadow masks and related cathodoluminescent screens.

In particular, the invention relates to a portion of the process steps employed in the manufacture of the front glass panel assembly of a flat tension mask color cathode ray tube. The front glass panel assembly includes a glass front panel, a support structure on the inner surface of the front glass panel and a tensed foil shadow mask affixed to the support structure.

In this specification, the terms "grille" and "screen" are used, and apply generally to the pattern on the inner surface of the front panel. The grille, also known as the black surround, or black matrix, is widely used to enhance contrast. It is applied to the panel first. It comprises a dark coating on the panel in which holes are formed to permit passage of light, and over which the respective colored-light-emitting phosphors are deposited to form the screen.

The holes in the grille must register with the columns of electrons passed by the holes or slots in the shadow mask. This is the primary registration requirement in a grille-equipped tube; the phosphor deposits may overlap the grille holes, hence their registration requirements are less precise.

In tubes without a grille, on the other hand, it is the phosphor deposits which must register with the columns of electrons. The word "screen", when used in the context of registration, therefor includes the grille where a grille is employed, as well as the phosphor deposits when there is no grille.

Historically, color cathode ray tubes have been manufactured by requiring that a shadow mask dedicated to a particular panel follow the panel through various states of the manufacturing process. Such a procedure is more complex than might be obvious; a complex conveyor system is needed to maintain the marriage of each mask assembly to its associated panel throughout the manufacturing process. In several stages of the process the panel must be separated from the mask, and the mating shadow mask cataloged for later reunion with its panel mate.

With the recent commercial introduction of the flat tension mask cathode ray tube, many process problems related to the curvature of the mask and panel have been alleviated or reduced. Necessarily, however, initial production of flat tension mask tubes has been based on continued use of the proven technology of mating a dedicated mask to a specific front glass panel throughout the manufacturing process. However, because the flat tension mask requires tension forces during the manufacturing process as well as after installation in a tube, somewhat cumbersome in-process support frames become necessary. These introduce complexity and expense in the manufacture of color cathode ray tubes of the tension mask type.

Thus, the desirability of simplifying the conventional production process remains as great as ever in the manufacture of cathode ray tubes of the flat tension mask type.

It has been recognized that color tube manufacture would be simplified if any mask could be registered with any screen (commonly termed an "interchangeable" mask), so that masks and screens would no longer have to be individually mated. Yet to this day, no commercially viable approach suitable for achieving such component interchangeability has been implemented or disclosed.

| Known Prior Art | |
|---|---|
| 2,625,734 | Law |
| 2,733,366 | Grimm |
| 3,437,482 | Yamada, et al. |
| 3,451,812 | Tamura |
| 3,494,267 | Schwartz |
| 3,563,737 | Jonkers |
| 3,638,063 | Tachikawa |
| 3,676,914 | Fiore |
| 3,768,385 | Noguchi |
| 3,889,329 | Fazlin |
| 3,894,321 | Moore |
| 3,983,613 | Palac |
| 3,989,524 | Palac |
| 4,593,224 | Palac |
| 4,692,660 | Adler |
| 4,695,761 | Fendley |
| FR1,477,706 | Gobain |
| GB2,052,148 | Sony |
| 20853/65 | Japanese |

Article "Improvements in the RCA Three Beam Shadow-Mask Color Kinescope", Grimes, 1954, Proceedings of the IRE, January, 1954, pgs. 315–326.

According to the parent applications, a manufacturing apparatus and process for color cathode ray tubes of the flat tension mask type is described wherein shadow masks and front panels are respectively interchangeable during mask-panel assembly.

This method achieves practical interchangeability of shadow masks in the manufacture of flat tension mask color cathode ray tubes by providing automatic means for adjusting the position size and/or shape of a mask such that its aperture pattern is brought into registration with a standard pattern.

More specifically, a method and associated apparatus is shown for changing a geometrical parameter of the mask pattern to achieve coincidence with a standard pattern which bears a fixed geometrical relationship to a predetermined screen pattern.

A position sensing means and a feedback control system is also shown and described in the parent application for applying controlled forces at a plurality of locations about the periphery of the mask for the purpose of moving the mask to a desired position and stretching it to a desired size and shape.

In both the parent applications an apparatus is schematically disclosed for changing the geometric configuration of the mask to achieve coincidence with a standard pattern that includes a stretching device consisting of clamps and links that applies a distribution of forces according to predetermined ratios around the periphery of the mask. It has been found that reduction rolling of the metal coils from which the masks are made, and particularly the rolling direction, appears to cause horizontal skewing during the initial stretching manipulation. The mask blank strain relieving process also appears to vary the position of the reference apertures in the mask from one mask to another.

OBJECTS OF THE INVENTION

It is an object of this invention to provide manufacturing apparatus and process for color cathode ray tubes of the flat tension mask type wherein shadow masks and front panels are respectively interchangeable during mask-panel assembly.

It is also an object of the invention to provide a method for achieving practical interchangeability of shadow masks in the manufacture of flat tension mask color cathode ray tubes by providing automatic means for adjusting the position size and/or shape of a mask such that its aperture pattern is brought into registration with a screen pattern.

It is a further object to provide such method and apparatus which compensates for screen position and geometry errors.

It is an object of this invention to provide, in a manufacturing process for color cathode ray tubes of the flat tension mask type wherein shadow masks and front panels are respectively interchangeable during mask-panel assembly, a method and associated apparatus for changing a geometrical parameter of the mask pattern to achieve coincidence with a screen pattern.

It is the primary object of the present invention to provide an improved stretching system.

BRIEF DESCRIPTION OF THE DRAWINGS

FIG. 14 consists of two plan views of a cathode ray tube screen showing two undesired screen conditions, including:

FIG. 14*a*, which is a simplified plan view illustrating a screen pattern position as translated and/or rotated with respect to its nominal position;

FIG. 14*b*, which illustrates a condition in which the screen pattern geometry is distorted, i.e., the size and/or shape of the pattern is distorted;

FIG. 15 is a perspective view of a panel holding fixture which makes possible adjustment of the position of the contained panel;

FIG. 18 depicts a grille aperture pattern as seen by a video camera and resulting pulse outputs, and comprises:

FIG. 18*a*, which is a plan view, greatly enlarged, of one corner of a grille;

FIG. 18*b*, which is a waveform indicating the horizontal output signal from a specific scan line; and FIG. 18*c*, a waveform indicating a vertical output signal;

FIG. 19 is a view in elevation of a representative section of a screen inspection machine designed specifically to accept a faceplate;

FIG. 21 is a partial view of an assembly machine providing for screen inspection and adjustment, and is composed of FIG. 21*a*, which is a view in elevation of representative section of the machine, and FIG. 21*b*, which is a view from the top of the machine;

FIG. 23 depicts a simplified version of the assembly machine of FIG. 21, and is composed of FIG. 23*a* which is a view in elevation of a representative section of the machine, and FIG. 23*b* which is a view from the top of the machine;

FIG. 24 depicts diagrammatically means for developing error signals which indicate directly the position differences between a shadow mask and a grille, and includes FIGS. 24*a* and 24*b*, which are views in elevation indicating the illumination of two specific apertures, and FIG. 24*c*, which is a greatly magnified plan view of the illuminated apertures;

FIG. 25 is an additional view of an assembly machine in which servo motors are mounted on a movable carrier;

DESCRIPTION OF THE PREFERRED EMBODIMENTS

Figure 1:
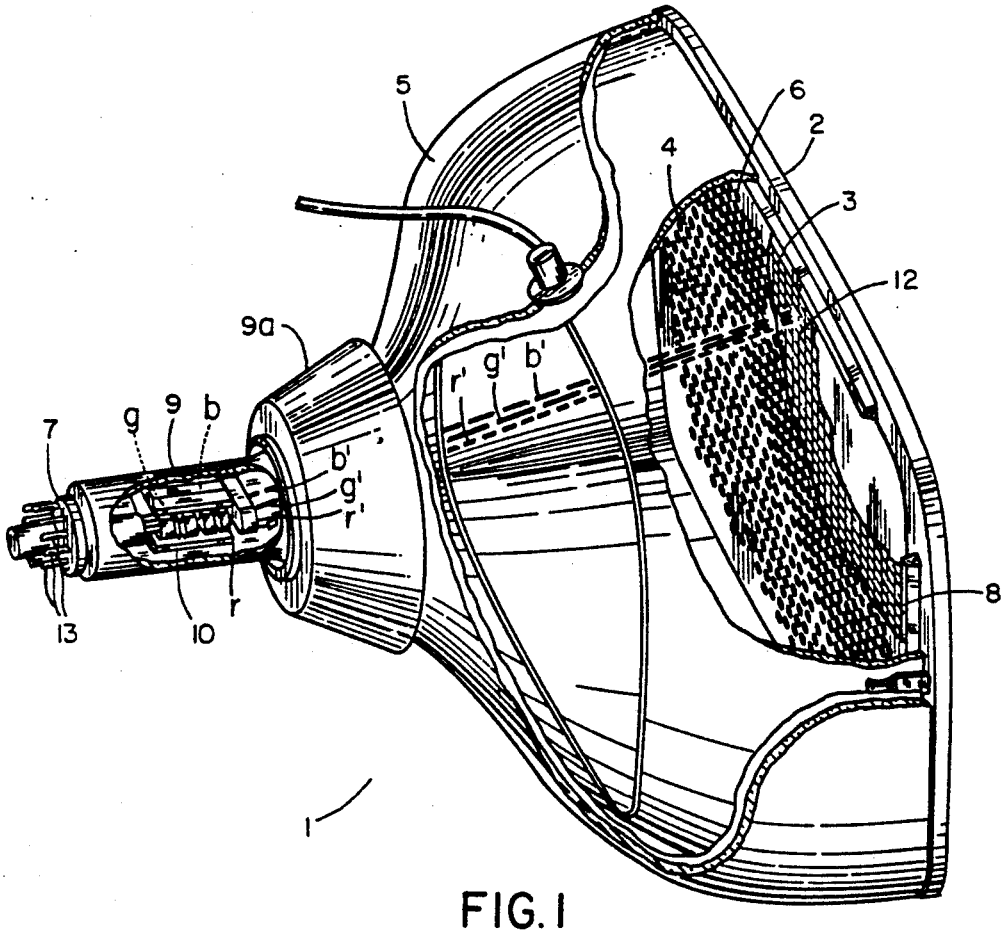
FIG. 1 illustrates a flat tension mask tube of the type with which this invention may be employed.

The present invention is directed towards means and method for applying a plurality of controlled forces to a foil shadow mask. The multiple controlled forces are used to tension the mask and conform it to register with a standard screen pattern on a CRT front panel. Interrogation of the mask and screen arrays for registration; and registration of the tensioned mask to the screened front panel are further discussed and claimed in copending U.S. patent application Ser. No. 710,738; filed May 29, 1991; and Ser. No. 799,590 filed Nov. 27, 1991, and do not constitute a part of the present invention.

This apparatus is for use in the manufacture of a color cathode ray tube having a shadow mask with a central pattern of apertures mounted in tension on a transparent flat front panel. The mask aperture pattern is in registration with a corresponding cathodoluminescent screen pattern on an inner surface of the panel. The front panel has mask support means secured to the screen-bearing inner surface of the panel along opposed edges of the screen pattern. The shadow masks and front panels are respectively interchangeable, according to the invention.

FIGS. 1 to 13 illustrate apparatus and method according to the parent application Ser. No. 223,475, now U.S. Pat. No. 4,902,257 in which interregistry of a screen pattern with a tension mask aperture pattern is achieved by stretching or otherwise expanding the mask to a predetermined standard. FIGS. 14 to 25 illustrate method and apparatus also according to the parent application Ser. No. 562,523 filed Aug. 3, 1990 principally focused on loading and shifting the mask relative to the screen in response to positive errors.

The apparatus essentially comprises optical screen reference means associated with a screen pattern on a front panel and indicative of the size, shape or position of the screen pattern. Optical mask reference means are associated with a mask aperture pattern on a shadow mask and indicative of the size or shape of the mask pattern. Means are provided for altering the size or shape of one of the patterns relative to the other. Control means including a feedback system is responsive to the mask reference means and the screen reference means and thus the size or shape relationship of said screen pattern and said mask pattern. The control means provides for controlling the expansion so that the mask reference means attains optical alignment with the screen reference means indicative of correspondence in size or shape between the mask and screen patterns in the geometric parameter. The apparatus includes means for securing the mask to the mask support means on the front panel with the mask and screen patterns in registration.

According to one embodiment of the present invention, an improved apparatus is provided for tensioning a metal foil shadow mask for a CRT that includes six to eight clamps along each side of the mask and an interrelated pyramidal or in-line "wiffle tree" linkage assembly for each side that distributes the forces among the clamps according to predetermined ratios.

By applying a programmed ratio of forces among the clamping elements, the strain throughout the mask during tensioning or stretching is substantially equal. This facilitates the registration of "reference" apertures in the mask with corresponding reference positions.

It has been found that production consistency in mask registration can be achieved by aligning only a few, on the order of four to nine, apertures in the mask with reference positions stored in memory. With this technique every aperture in the mask will be aligned with its associated grille aperture within 0.35 mils.

Registration is achieved by alternately stretching the mask and shifting the mask in gross relation to the faceplate(or visa-versa) to which it is to be attached.

Initial tensioning of the mask is provided by the present clamping apparatus to 25 to 26 newtons/cm. in both x and y directions utilizing apertures in the mask array as references. Additional array holes can be used as further references such as the mid-holes along each border row and the array central hole. These holes are viewed with video microscope assemblies and its video signals are processed and utilized by a microprocessor that compares the position of these reference holes in the mask to pre-stored reference values.

If the apertures are not all "captured" i.e.; do not fall within the standard reference values, which may also be displayed on adjustable cross hair monitors, a carriage for the stretcher and mask, or the faceplate, is shifted in three coordinates i.e. x, y and angular, until two or more apertures are brought to coincidence with a reference. This capturing, and/or orienting, rigid body motion is called "installation error." It constitutes by far the largest motion component in the registration process.

At this stage in the alignment process, the maximum deviation of the remaining apertures from the reference values is on the order of 1 mil. This "size" deviation appears to be a strong function of variations in the mask blank strain relieving process.

After the "capturing" and/or "orienting" motions are performed, the mask is stretched differentially in x and y directions in response to the extent of deviation of the remaining apertures from their corresponding desired reference positions stored in a microprocessor. This procedure eliminates "size" and "skewing" deviations.

Thereafter, position "optimizing" is effected by slight shifting of the mask carriage as a rigid body, again in the three coordinate directions. This positioning is continued until the deviations of the reference apertures from the corresponding reference positions are all about the same magnitude.

In the stretching assembly, articulation of the clamping assemblies on each side is accommodated through the "wiffle tree" which is the linkage controlling the shape of the force profile on each side. The linkage geometry provides (when eight clamps are provided on a side) equal pulling force to the four middle clamping assemblies on each side, approximately 1.3 times that value to the next adjacent outer clamping assemblies, and approximately 1.7 times that value to the outermost clamping assemblies at the corners of the mask. This force profile minimizes tears originating at the aperture array corners of the mask which can be tensed to levels on the order of 30 newtons/cm. High array corner stresses are associated with the density difference between the mask array and its surrounding solid border.

ENVIRONMENTAL AND PARENTAL DISCLOSURE

FIG. 1 depicts a flat tension mask color cathode ray tube 1 including a glass front panel 2 hermetically sealed to an evacuated envelope 5 extending to a neck 9 and terminating in a connection plug 7 having a plurality of stem pins 13.

Internal parts include a mask support structure 3 permanently attached to the inner surface 8 of the panel 2 which supports a tension shadow mask 4. The mask support structure 3 is machine ground to provide a planar surface at a fixed distance "Q" from the plane of the inner surface 8. On the inner surface 8 of the panel 2 is deposited a screen 12 comprising a black grille and a pattern of colored light emitting phosphors distributed across the expanse of the inner surface 8 within the inner boundaries of the support structure 3. The phosphors, when excited by the impingement of an electron beam, r', g', b', emit one of red, green and blue colored lights.

The shadow mask 4 has a large number of beam-passing apertures 6. The mask 4 is permanently affixed, as by laser welding, to the ground surface of the support structure 3.

In the neck 9 of the tube 1 is installed a cluster 10 of three electron guns identified as r, g and b. The electron guns emit three separate electron beams designated as r', g' and b' directed toward the mask 4. The electron beams are electronically modulated in accordance with color picture signal information. Deflected by magnetic fields produced by a yoke 9*a* external to the tube, the electron beams r', g' and b' are caused to scan horizontally and vertically such that the entire surface of the mask 4 is swept in a periodic fashion to form an image extending over substantially the entire area of the screen 12 within the inner boundaries of the mask support structure 3.

At positions on the mask 4 where there is an aperture 6, each of the three electron beam passes through the mask and impinges on the screen 12. Thus, the position of the mask 4 with its pattern of apertures 6, the positions of the electron guns r', g' and b' at 10, and the height "Q" of the support structure 3 control the locations where the electron beams r', g' and b' impinge on the screen 12.

For proper operation of the tube 1, there must be on the screen 12, a light emitting phosphor deposit of the proper color characteristic corresponding to the color information of the impinging electron beam r', g' or b'. Further, for proper operation, the center of the area of impingement of the electron beam must coincide within a narrow tolerance with the center of the associated phosphor deposit.

When these conditions are met over the entire surface of the screen, then mask and screen are said to be registered.

The rectangular area within which images are displayed, i.e. the area covered by the electron beams on the screen, is larger than the corresponding area on the mask through which those electron beams pass; the linear magnification from mask to screen is on the order of a few percent. Detailed studies have shown that this magnification varies slightly across the screen. Therefore, when a phrase such as "registration between mask and screen patterns" or "registration between the apertures pattern of the mask and the screen pattern" is used in this specification, it does not mean that the two patterns are congruent like a photographic negative and its contact print. Rather, it means that the two patterns are related to each other as required in a color tube of the flat construction described, using a support structure of predetermined height and having a predetermined spacing from mask to screen. Such registration of mask and screen is with respect to the electron beam center of deflection.

In a flat tension mask tube, the tension mask is typically made of steel foil about 0.001 inch thick. The mask is under substantial mechanical tension; the stress may be between 30,000 and 50,000 pounds per square inch. The mask is therefore stretched to a significant degree, the elastic deformation exceeding one part in one thousand, e.g. the conventional flat tension mask manufacturing method puts each mask into an elastically deformed condition before producing, by photolithography, the screen which will be used with that mask.

The present invention, on the other hand, calls for all screens to be made from a common master so that they are interchangeable. The invention also recognizes that the unstretched masks, are very nearly alike, and takes advantage of the elastic deformation of a mask that occurs when a mask is stretched. By applying controlled forces to clamps gripping peripheral portions of the mask, each mask is stretched so that its size and shape conform to predetermined standard. If desired, the required forces may be substantially reduced by heating the mask during the stretching process.

Figure 2:
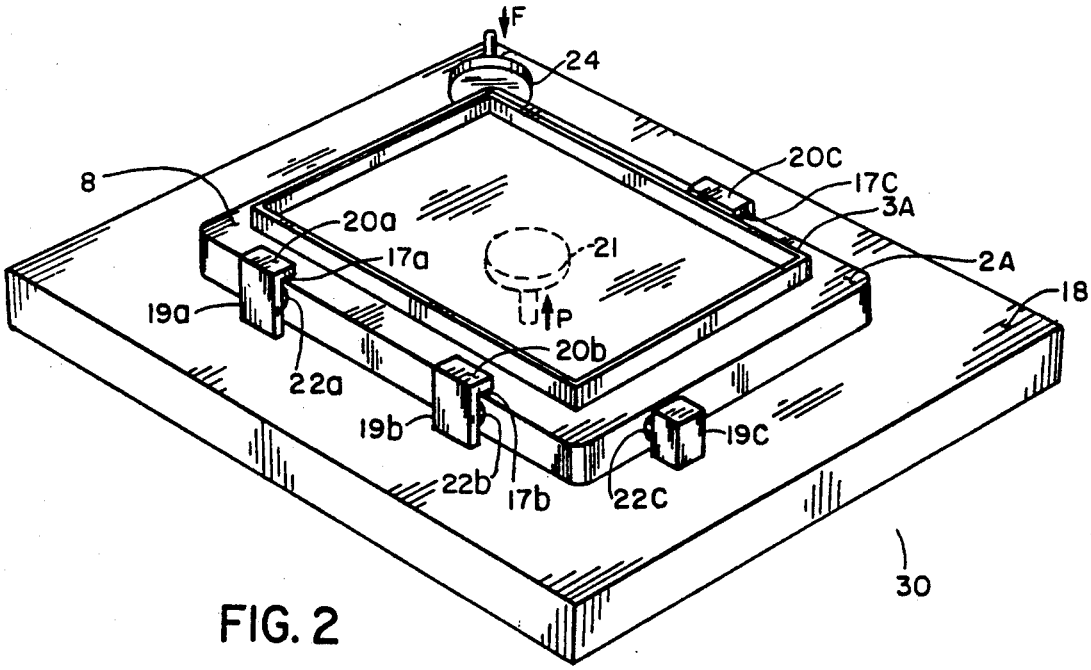
FIG. 2 illustrates a universal holding fixture.

FIG. 2 describes a six-point universal holding fixture 30 for glass front panel assemblies to be used during all manufacturing processes requiring reproducible positioning of a panel 2A in reference to an established set of datum coordinates. Panel 2A, carrying mask support structure 3A, is shown on a fixture plate 18 using a holding method comprising three half-ball locators 22*a*, 22*b*, 22*c*, attached to posts designated as 19*a*, 19*b* and 19*c*, to control lateral position, while three vertical stops 20*a*, 20*b* and 20*c* control vertical position. Vertical stops 20*a*, 20*b* and 20*c* are provided with firm but relatively soft contact surfaces 17 made of a material such as Delrin TM to protect the inner surface of panel 2A. A pressure device 21, shown in phantom lines below panel 2A, exerts an upward vertical force P to assure firm contact between the inner surface and three vertical stops 20*a*, 20*b* and 20*c*. A second pressure device 24, exerting a horizontal force force F in the direction toward the corner between posts 19*b* and 19*c*, assures firm contact between the panel 2A and the three half-balls, 22*a*, 22*b*, 22*c*.

Vertical stops 20*a* and 20*b* are co-located with posts 19*a* and 19*b*, but the third vertical stop 20*c* is completely separated from post 19*c*.

By controlling within close limits the position of the three half-ball locators 22*a*, 22*b*, 22*c*, as well as the plane defined by the three vertical stops 20*a*, 20*b*, 20*c* in different work stations in the manufacturing process, the position of a given panel in each of such work stations may be accurately duplicated.

Figure 3:
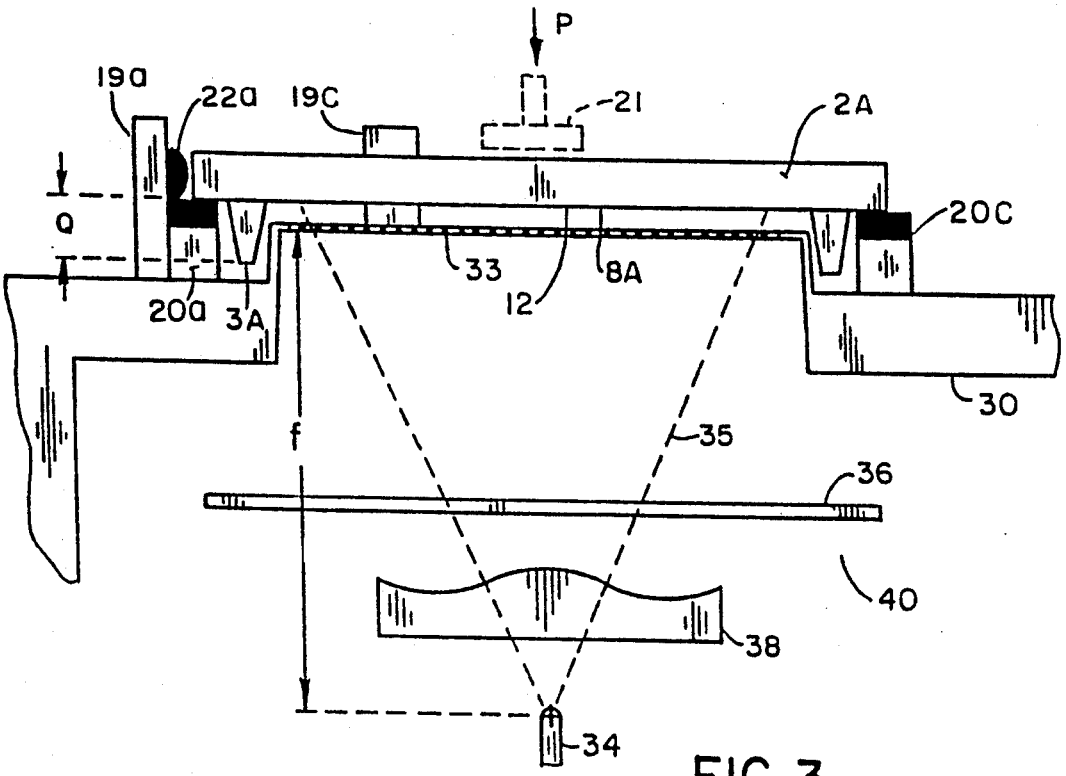
FIG. 3 is a modified version of the universal holding fixture depicted in FIG. 2, adapted for use with a lighthouse.

FIG. 3 illustrates a modification of the universal holding fixture 30 adapted to a lighthouse 40. It will be noted that panel 2A and vertical stops, two of which are depicted (20*a* and 20*c*) have been inverted while posts, two of which are depicted at 19*a* and 19*c*, remain upright to allow insertion of panel 2A from above. Pressure device 21 is optional in this modification, since the weight of panel 2A may suffice to ensure proper seating on the vertical stops.

As is well known in the art of manufacturing color cathode ray tubes, a lighthouse is used for photo-exposing light-sensitive materials applied to the inner surface 8 of a panel 2A. Four separate exposures in four different lighthouses are needed to produce the black background pattern and the three separate colored light emitting phosphor patterns which comprise the screen 12. Photoexposure master 33 is permanently installed in lighthouse 40, with the image-carrying layer facing upward and spaced a very small distance (0.010", e.g.) from the inner surface of panel 2A. At a fixed distance "f" from the plane of the photoexposure master 33 is placed an ultraviolet light source 34 which emits light rays 35 which stimulate the electron beam paths in a completed tube.

A shader plate 36 modifies the light intensity over the surface of the mask so as to compensate for the variation of distance from the light source and for the variation of the angle of incidence, thereby achieving the desired exposure in all regions. Lens 38 provides for correction of the paths of the light rays so as to simulate more perfectly the trajectories of the electron beams during tube operation.

Experience has indicated that screen patterns produced by following the procedures just described are sufficiently accurate for use in high resolution tubes, provided that the Q height of support structure 3, measured from the inner surface 8A of panel 2A to the machine ground top surface of the support structure, is held to a very close tolerance.

Figure 4:
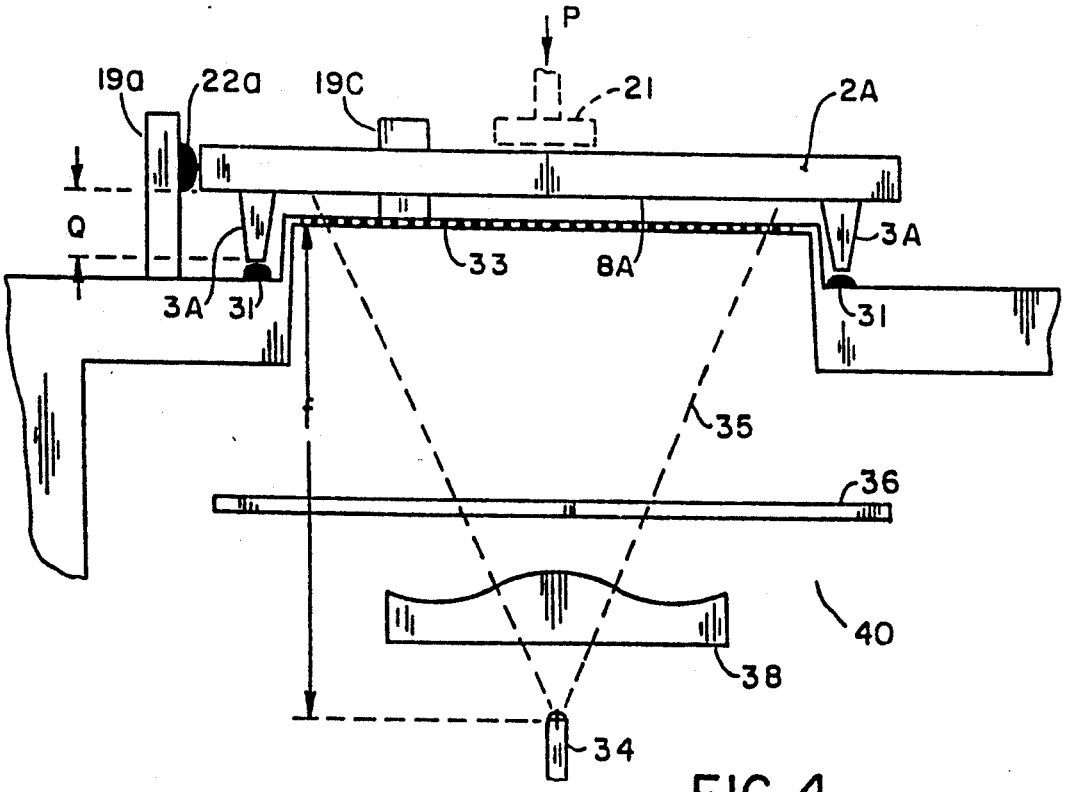
FIG. 4 is a modification of the apparatus depicted in FIG. 3 which accommodates a wider tolerance in the Q height of the mask support structure.

A modification of FIG. 3, depicted in FIG. 4, accommodates a wider tolerance in the Q height of the mask support structure. Here the vertical stops are replaced by half-balls 31, and the panel 2A rests, not on its inner surface, but on the ground top surface of support structure 3A. If, for example, that structure on a given panel is 0.002" too high, that panel sits that much higher during exposure, and the light pattern recorded on it is larger than normal. This is exactly what is required; when a mask is eventually affixed to this support structure, it will be 0.002" farther away from the panel, causing the electron beams also to form a larger pattern and thus compensate for excess vertical height Q. In effect, then, an interchangeable screen is produced in spite of the 0.002" error in support structure height Q.

The process for producing the screen pattern described in connection with FIGS. 3 and 4 differs from the conventional process in that for each of the four photo exposures, a permanent master is used rather than an individual mask uniquely associated with a particular screen. However, because this invention makes it unnecessary to match each screen to a particular mask, other more economical processes may be used to manufacture the screen pattern. Printing processes such as, for example, offset printing are particularly well adapted to producing the required precise screen pattern on flat glass plates. The important aspect of using offset printing is that four separate processes of photo exposure, development and drying, followed by coating for the next process, are no longer required. In effect, offset printing offers the possibility of inexpensively producing an interchangeable screen pattern as required by this invention.

If offset printing or similar process is employed, the height Q of support structure 3A must be controlled to an accuracy appropriate to the special requirements of this application.

Figure 5:
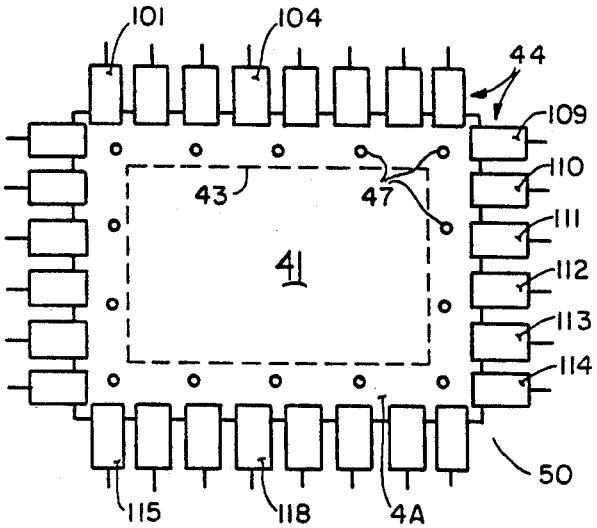
FIG. 5 schematically illustrates a machine for adjusting the size, position, and/or shape of a shadow mask in accordance with the principles of this invention.

FIG. 5 depicts schematically a machine 50 for applying controlled forces to a plurality of clamps gripping peripheral portions of the mask, capable of moving and elastically deforming the mask until its position, size and shape conform to a predetermined standard. The machine is also equipped to move a screened panel into a specified position adjacent to the mask and to weld the mask to the support structure; these features, not shown in FIG. 5, will be described in detail later.

FIG. 5 depicts a rectangular, in-process shadow mask 4A having a wide peripheral portion. This is the form in which the mask emerges from the photoetching process. The central apertured region 41 of the mask is bounded by rectangle 43. Outside this rectangle and surrounding it there is a row of widely spaced position-sensing apertures 47. Optical markers attached to machine 50, to be described in detail later, serve as position references and present, in this embodiment, the afore-discussed predetermined standard. It is the task of machine 50 to apply a distribution of forces to the mask such as to bring all apertures 47 into coincidence with their corresponding optical markers.

Located around the periphery of mask 4A is an array of clamps 44 which may each comprise a pair of actuatable jaws. For purposes of illustration, twenty eight clamps are depicted. The reason for having a plurality of clamps on each side is that the individual clamps must be free to move apart as needed when the mask is stretched. The same plurality also permits application of a desired distribution of forces about the periphery of mask 4A.

It must be kept in mind that the apertured central region 41 of the mask inside rectangle 43 has an average elastic stiffness considerably smaller than that of the solid peripheral portion. Since it is desirable in the stretching process to essentially maintain the rectangular configuration of the central apertured region, stretching forces must be graded, with the magnitude of each force related to the local elastic stiffness encountered at each clamp 44. For example, the opposing clamps 101 and 115 act on solid material at one end of the mask; they therefore require considerably greater force than opposing clamps 104 and 118 which act on a portion containing largely apertured material.

Figure 6:
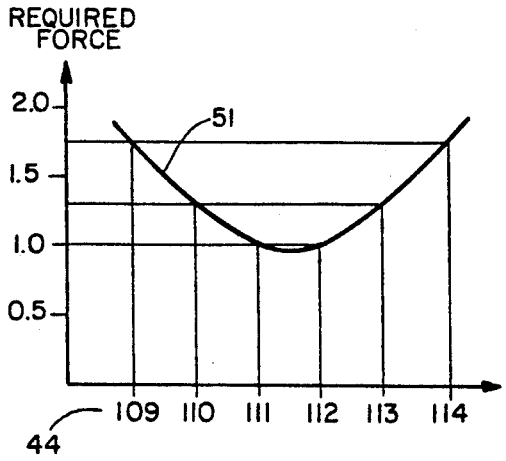
FIG. 6 is a curve representing the distribution of required forces along one edge of a shadow mask.

FIG. 6 depicts a curve 51 representing the distribution of required force along one edge of mask 4A. It is seen that the force required near the corners is about 70% higher than near the center.

Figure 7:
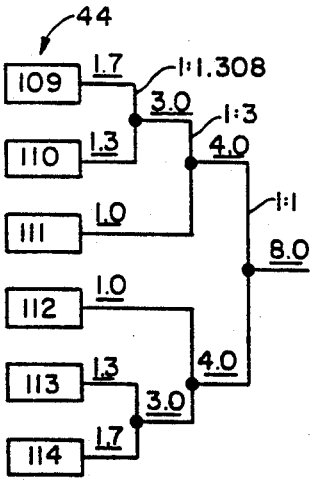
FIG. 7 illustrates the use of levers to distribute forces along edges of a mask.

FIG. 7 illustrates the use of levers to distribute forces according to predetermined ratios. The figure shows six clamps labeled 109–114, assumed to be attached to one of the short edges of the mask. The desired ratio of force are, in this example: 1.7, 1.3, 1, 1, 1.3, 1.7. Forces along the pull rods are underlined in the figure; the figures associated with the levers indicate lever ratios. It is seen that any desired ratio of forces for any desired number of clamps along one edge can be so generated.

Figure 8A:
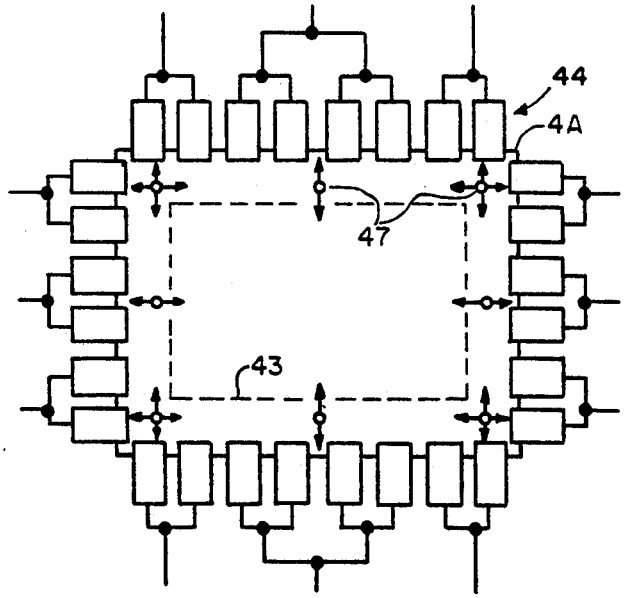
FIG. 8*a* depicts a modification of a FIG. 5 apparatus having a reduced number of independently variable applied forces.

FIG. 8A illustrates a modification of FIG. 5, where there are still twenty-eight clamps but only eight position sensing apertures 47, and a total of twelve independently variable forces. Adjacent clamps are interconnected by levers as just explained, with the result that there are just three independent forces along each side. The four position sensing apertures located in the corners are designed to detect position errors along both the x and y axes; those four apertures positioned near the center of each side respond only to radial, i.e. inward or outward displacements. Thus the total number of position error signals is twelve, equal to the number of independently controllable forces.

In addition to applying forces which act at right angles to the edges of the mask, it may sometimes be desirable to apply tangential forces in a direction parallel to an edge. FIG. **8*b* illustrates such an arrangement, using as an example a tension mask in which apertures 406 within boundary 443** are parallel slots rather than round holes. Slotted masks are commonly used in color cathode ray tubes intended for television receivers. The slots conventionally run along the vertical (y) direction; they are not continuous from top to bottom, but are bridged at regular intervals by tie-bars to increase the mechanical stability of the mask.

In a color cathode ray tube of the flat tension mask type, a similar pattern of apertures, i.e. slots parallel to the y-axis, bridged at regular intervals, may be used. Only the x-coordinate of the mask pattern need register with the screen pattern, assuming the phosphor stripes are continuous. Parallel to the slots, along the y-axis, high mechanical tension is applied; the amount of this tension is not critical so long as the elastic limit of the mask material is not exceeded. Along the x-axis, a carefully controlled amount of tension is applied; because the mechanical stiffness of the delicate bridges (not shown) is rather small the tension in this direction must be low.

Machine 450 in FIG. **8*b* is designed to apply controlled forces, including tangential forces, to a slotted mask 404. Along the two vertical edges, clamps 444** are pulled outwardly by forces acting at right angles to those edges. The four clamps located near the middle of each vertical edge are interconnected by levers. Six independently controllable forces $F_1$ through $F_6$ are applied to these two edges.

Turning now to the two horizontal edges, predetermined forces $F_O$ which need not be controlled by feedback are applied at right angles to these edges near the four corners of the mask. However, the two middle clamps on each horizontal edge are pulled generally outward by forces $F_R(1)$, $F_R(2)$ which are not perpendicular to the edge but have a controllable tangential component.

FIG. **8*c* shows how such a force may be generated. Two stepper motors 424*a* and 424*b* are mounted on frame 432 of machine 450 under angles of plus and minus 45 degrees, as indicated. The motors carry reduction gears 428*a*, 428*b*, terminating in pull rods 431*a* and 431*b*, respectively. A third pull rod 430, linked to the first two pull rods by springs 425*a*, 425*b*, connects to the lever which drives the two middle clamps. Clamps 460 along the horizontal edges are constructed somewhat differently from clamps 444**. They are pivoted as shown so as to permit the application of tangential force components without producing local moments at the edge of the mask.

In operation, the two motors are caused to advance their respective pull rode **431*a*, 431*b*, until a predetermined force $F_O$ is generated on pull rod 430**. This force acts at right angles to the edge, and its exact value is not critical.

Assume now that to compensate for a variation in mask thickness, the center portion of the mask needs to be pulled to the right as illustrated by $F_R(1)$ shown in FIG. **8*b*. To this end, stepper motor 424*a* is advanced so that its pull rod 431*a* is pulled closer to the frame. At the same time, motor 424*b* is backed up so that pull rod 431*b* is extended beyond its normal position. As a consequence, the lower end of pull rod 430 moves to the right, and a tangential force component $F_T(1)$ is generated. This, together with the perpendicular component $F_O$, produces the desired resultant force $F_R(1)$. Eight position sensors (not depicted) using position sensing apertures 447 are designed to respond solely to positioning errors in the axis x. There are also eight independently controllable forces: $F_1$ through $F_6$, and the two tangential components $F_T(1)$ and $F_T(2)$, of which only the first is shown in FIG. 8*c***.

Figure 9:
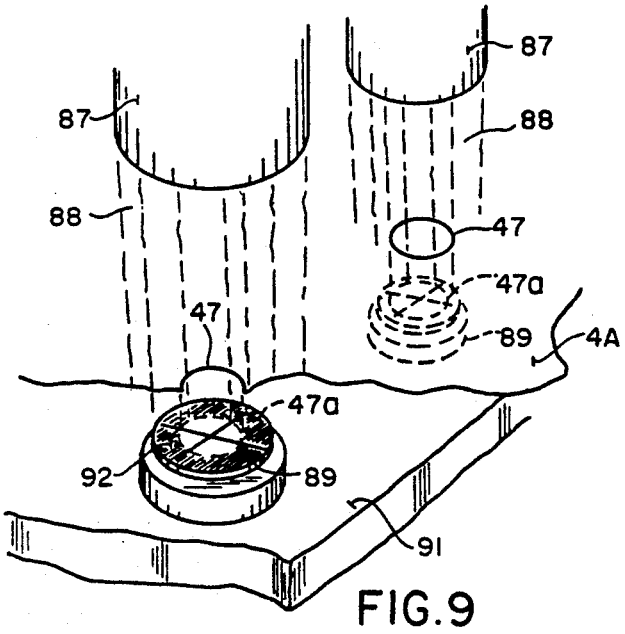
FIGS. 9 and 10 illustrate a quadrant detector optical sensing system for sensing the location of sensing holes in a mask under tension, relative to reference points independent of the mask.

FIG. 9 illustrates the principle of operation of a commercially available quadrant detector optical sensor 89 which may be used in machine 50 to generate the needed positioning error signals. Such a sensor is sold by United Detector Technology of California and consists of a semiconductor chip having a photosensitive region in the shape of a circular disc which is divided into four 90 degree sectors. The photocurrent from each sector is separately available externally.

In FIG. 9, mask 4A is assumed to be in the correct state of tension with the position sensing apertures 47 in registration with optical detection light sensors 89. Each aperture 47 is fully illuminated by a light source 87 emitting a light beam 88. Light beam 88 may be produced by a laser or by a more conventional optical source.

A plurality of quadrant detector light sensors 89 is mounted on a plate 91 whose position with reference to the frame of machine 50 is precisely defined, as described in detail later in connection with FIG. 13. The active area 92 of the quadrant detector light sensor is in vertical alignment with the desired position of position sensing aperture 47. The illuminated area **47*a* represents the image of aperture hole 47 projected on active surface 92 of quadrant detector light sensor 89**.

The diameter of light beam 88 is larger than the diameter of the active area 92 of quadrant detector light sensor 89, while the diameter of position sensing aperture 47 is substantially smaller. If a position sensing aperture is in exact concentric alignment with the active area 92 of its quadrant detector light sensor 89, all four sectors produce the same photocurrent; a matrixing circuit well known in the art, designed to indicate any unbalance between the sector currents, will then indicate zero position error in both x and y coordinates. More specifically, the matrixing circuit provides two outputs. The first indicates the difference between the sum of the two left sector currents and the sum of the two right sector currents; this indicates an error in the x coordinate. The second output indicates the difference between the sum of the two upper sector currents and the sum of the two lower sector currents, thereby signaling an error in the y coordinate.

Figure 10:
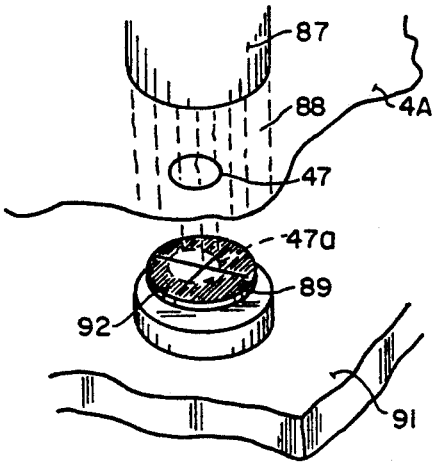

FIG. 10 illustrates a condition where a position sensing aperture 47 is not aligned with the active area 92 of quadrant detector sensor 89; therefore, the projected image 47*a* is not aligned, the four sectors are unequally illuminated, and a non-zero output signal is generated. In the specific case, the sum of the left sector currents is larger than that of the right sector currents, producing an output in the x coordinate indicating that aperture 47 is too far to the left.

Figure 11:
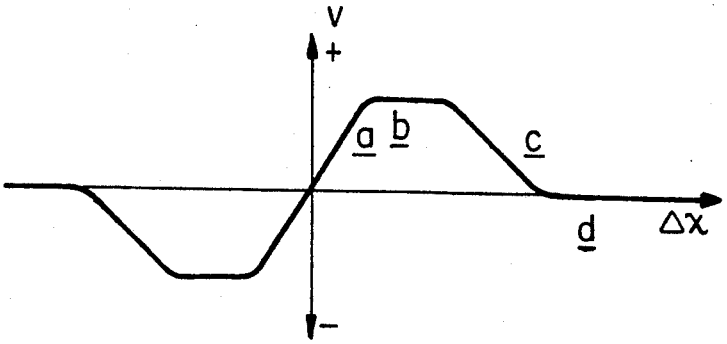
FIG. 11 is a curve showing the output voltage from a matrixing circuit forming part of the quadrant detector optical sensing system.

FIG. 11 indicates the output voltage V from a matrixing circuit of the type described, plotted against the displacement delta x of the aperture. The steep center portion a corresponds to displacements smaller than the radius of position sensing aperture 47. For larger displacements, the output becomes constant(shown at b). Further displacement causes the image of position sensing aperture 47 to cross the edge of active area 92; the output, shown at c, decreases and reaches zero d as the image of aperture 47 leaves the active area. The distance between point d and the center of the plot indicates the maximum positioning error which this particular sensor and position sensing aperture combination can read.

Optical detection is by no means the only way of determining position errors. For example, very precise position measurements can be made using a combination of air nozzles, mask apertures and flow or pressure gauges.

The position error signals are utilized, as previously explained, to correct any errors in mask position and orientation, to stretch the mask and to adjust its shape. Some of these operations may require certain clamps 44 to back up, i.e. to provide slack so that other clamps can move outward without increasing mask tension. However, the force exerted by each clamp always remains directed outward; backup is achieved by reducing the force exerted by one clamp momentarily below the force of the opposing clamp or clamps.

The required pulling forces may be produced by hydraulic, pneumatic or electric drives. For example, as depicted herein, electric stepper motors, geared down so as to produce large force with small displacement, are well adapted to be driven by computer controlled pulses. To produce an adjustable force rather than a controlled displacement, a spring may be inserted between motor and clamp.

It should be remembered that in practice, one motor may drive a plurality of clamps through a force distributor such as the one depicted in FIG. 7.

According to the invention, computer means are provided for adjusting the force produced by each motor or other force generator. If there were only one motor and one error-sensing means, the feedback loop would be a simple servo and no computation would be needed. The same would be true if each motor influenced only the positioning error of one coordinate in one particular sensor location; a separate loop would then be required for each motor-sensor pair, but there would be no interaction between pairs.

In practice, the situation is more complex; each motor causes displacements at most or all sensor locations. These displacements are largest close to the clamp driven by the particular motor, and much smaller elsewhere but if there are several or many independent motors, these contributions add up. Each such contribution can be characterized by a matrix coefficient, and for a given configuration of motors, clamps and sensor locations, these coefficients can be determined once and for all, and stored in computer memory. The problem of determining the values of the N forces required to reduce N position errors to zero is then merely that of solving N simultaneous linear equations, a task easily and rapidly performed by a computer.

The clamps used to transmit the controlled forces to the periphery of the mask must be capable of withstanding a pulling force of the order of 30 pounds per inch of width, with a sufficient safety margin. Uncoated steel jaws may be used, in which case clamping forces of several hundred pounds are needed for clamps about one inch wide; elastomeric coatings greatly reduce this requirement but may introduce an element of wear. Hydraulic drives are well adapted to produce the large static force required upon closure. The jaws are preferably held open by relatively weak springs when hydraulic pressure is not applied. During normal operation of machine 50, jaw pressure is applied or released in all clamps at the same time, so that only a single valve is required to apply or remove hydraulic pressure.

Figure 12:
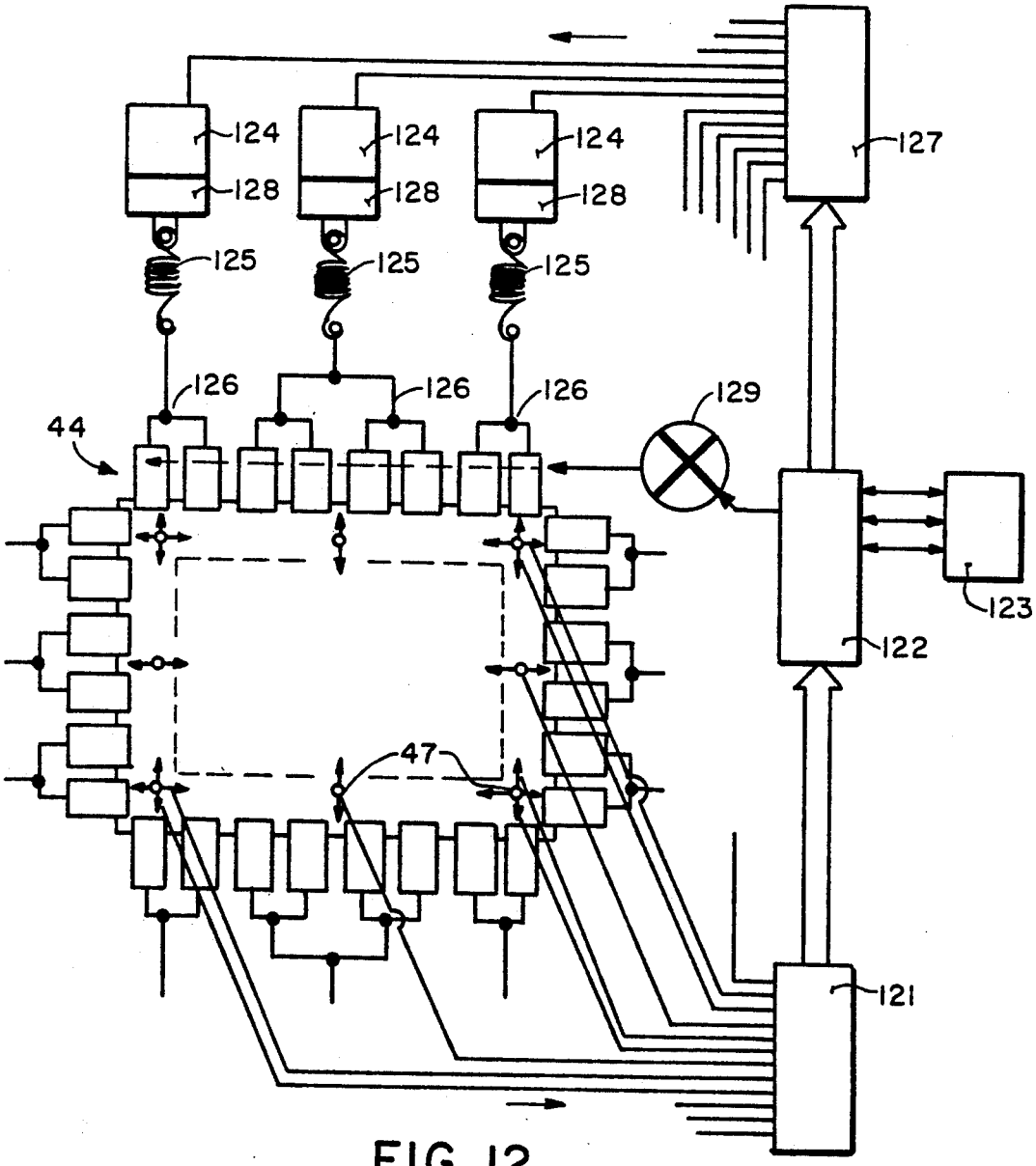
FIG. 12 is a schematic representation of a system including multiple feedback loops.

FIG. 12 is a schematic representation of the multiple feedback loops above-described. Position error signals from position sensing apertures 47 and quadrant detector light sensors 89 are analog signals; they are converted to digital signals in analog/digital converter 121 and are then sent to computer 122. The computer, having the appropriate matrix coefficients stored in its memory 123, calculates the forces to be generated by stepper motors 124 and, based on the known constants of springs 125 and of the force distribution system 126 which transmits the force generated by each motor to several clamps 44, computes the number of steps by which each motor should be advanced or retarded. It also generates the appropriate number and type (forward or backward) of pulses. These pulses are amplified in power amplifiers 127 and applied to the motors 124 which are equipped with reduction gears 128.

The computer also controls the opening and closing of hydraulic valve 129 which applies hydraulic pressure to clamps 44, forcing the jaws to close when the mask is to be clamped and allowing them to open when the mask is to be released.

Figure 13A:
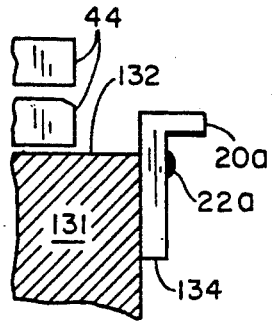
FIG. 13*a*–13*f* illustrate an apparatus and method for carrying out a mask mounting process.
Figure 13B:
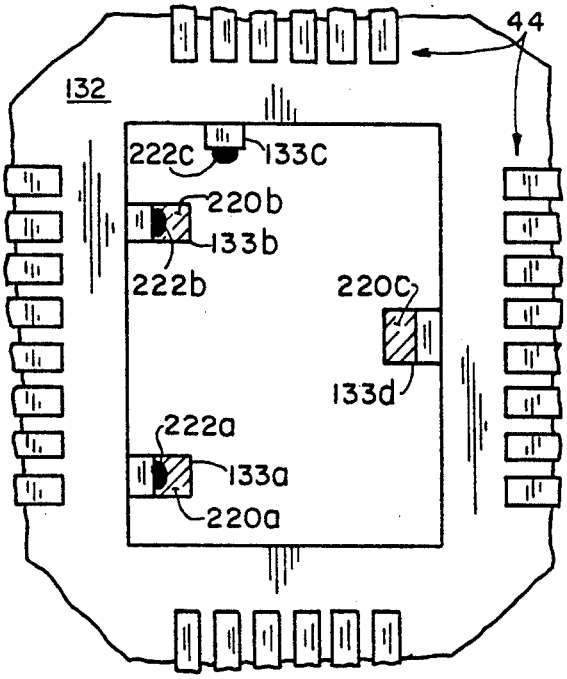

The arrangement described in connection with FIG. 12 lends itself to the process of bringing the mask into registration with a predetermined standard pattern. FIGS. 13*a* and 13*f* illustrate an environment in which this arrangement is used to manufacture mask-panel assemblies for flat tension mask color cathode ray tubes. It is to be understood that the machine 130 depicted in FIGS. 13*a*–13*f* comprises, or operates in connection with, the elements of FIG. 12.

The most important element of machine 130 is a ed frame 131. One side of this frame is depicted in vertical section in FIG. 13*a*, and a view of the entire inside portion of the frame as seen from below is depicted in FIG. 13*b*. The top of the frame is a flat machined surface on which clamps 44 can slide. The frame forms a window-like opening, somewhat smaller(for example, by one inch about both x and y) than the mask in its original, uncut form.

Four indexing stops 133*a*, 133*b*, 133*c* and 133*d* are shown as being attached to the inside of the frame. The stops 133*a* and 133*b*, placed symmetrically along a common edge, carry half balls 222*a*, 222*b*, as well as vertical stops 220*a*, 220*b*. The half-ball 222*c* is positioned around the corner from 222*b*, but the third vertical stop 220*c* is in the center of the edge opposite the 133*a* and 133*b* stops.

These six indexing elements, together with means (not shown) for pushing a panel upward and sideways to maintain contact at all six points, constitute a form of the six-point universal holding fixture 30 previously described.

Figure 13C:
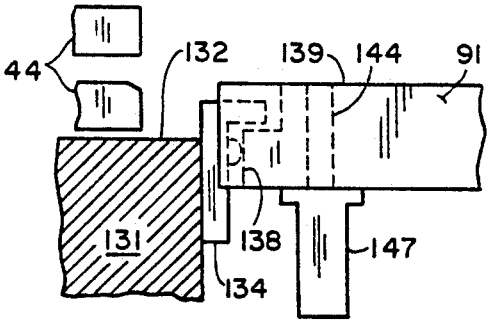
Figure 13D:
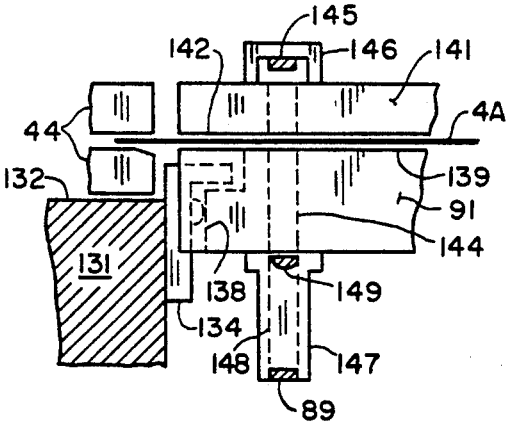

A bottom plate 91, seen in section in FIGS. 13*c* and 13*d*, can also be pushed against the same indexing elements. It is large enough to nearly fill the window in frame 131, leaving just a narrow slit all around. It has four cut-out portions 138 to accommodate the six indexing elements, so that bottom plate 91 can be precisely seated. When plate 91 is so seated, its flat top surface 139 is horizontal, parallel to the machined top surface 132 of the frame 131, and coplanar with the top surface of the lower jaws of clamps 44 which rest on surface 132.

There is also a top plate 141 with a flat horizontal bottom surface 142 which can be brought down from above to set itself against the top surface 139 of bottom plate 91. Both bottom and top plates are equipped with optical devices to be described later.

Instead of the top plate, the welding head 143 of a high powered laser (see FIG. 13*f*) may be brought down to where its focal point lies in a plane just above the machined top surface 139 of the bottom plate.

In the starting condition of machine 130 shown in FIGS. 13*c*, bottom plate 91 is seated against the six indexing elements. Two retractable locating pins (not shown) protrude from top surface 139. Clamps 44 are retracted. A mask 4A is now placed on surface 139, with appropriate pre-etched apertures to fit the two locating pins.

Next, top plate 141 is lowered until it seats itself against mask 4A. The two protruding locating pins slip into clearance holes (not shown) in the top plate. Clamps 44 are advanced until they overlap the mask enough to allow clamping; they are then closed (FIG. 13*d*). Thereupon, the top plate is lifted by a small amount to free the mask, and the two locating pins are retracted.

Corresponding to every position sensing aperture 47 in the mask (not shown in FIGS. 13*a*–13*f*) there is a cylindrical hole 144 in the top and bottom plates. Top plate 141 carries a lamp 145 in a small housing 146 over hole 144. Bottom plate 91, which remains in contact with the mask, carries an optical system 147 consisting of a quadrant detector light sensor 89 at the end of a tube 148, and a lens 149, which serves to focus an image of the mask position sensing aperture 47 upon the quadrant detector light sensor 89. The optical system 147 attached to the bottom of the bottom plate 91 is designed to allow small lateral mechanical adjustments so as to set its position with great accuracy.

Returning now to the operating sequence of machine 130, the feedback system for positioning, stretching and shaping the mask is energized next. Preferably this is done gradually, so as to avoid undesirable mechanical transients. Once all positioning errors are within tolerance, the clamp positions are frozen; for example, if stepper motors are used to pull the clamps, these motors are electrically locked in position.

Figure 13E:
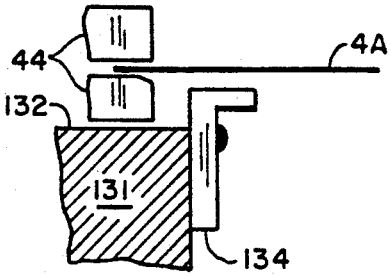
Figure 13F:
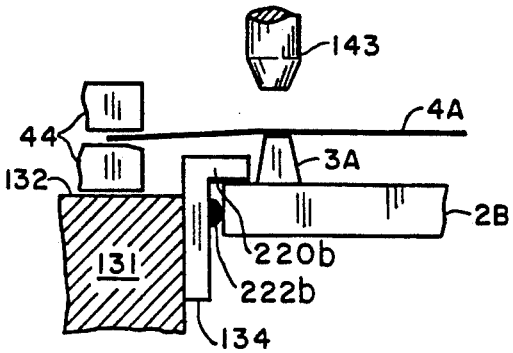

Top and bottom plates are then both withdrawn and moved out of the way (see FIG. 13*e*). A screened panel 2B is inserted into the machine and lifted up against the mask 4A until it is seated against the six indexing elements. At this point, the ground top surface of mask support structure 3A touches the underside of the stretched mask and, preferably, lifts it a few thousandths of an inch. Welding head 143 is now lowered (FIG. 13*f*) and the mask is welded to the support structure. While other ways are available, this may be done in accordance with U.S. Pat. No. 4,828,523, assigned to the assignee of this invention.

Next, the peripheral portion of the mask is cut off, preferably using the same laser, and the welding head 143 is lifted and moved out of the way. The clamps 44 are opened and retracted, leaving the cut-off peripheral portion of the mask to be discarded. Finally, the completed assembly of panel 2B, and mask 4A—the latter now welded to mask support structure 3A—is lowered and removed from the machine. The two locating pins are once again extended, and the machine is ready for another cycle.

The process described in the preceding part of this specification is based on the assumption that when faceplate 2A is pressed against half-balls 22*a*, 22*b* and 22*c*, and the vertical stops 20*a*, 20*b* and 20*c*, the screen pattern is located precisely where it should be. But in practice, there are sometimes departures from the ideal situation. These departures fall into two categories:

(1) The entire screen pattern may be translated and/or rotated with respect to its nominal position, as indicated in FIG. 14*a*; note that there is no change in the geometry (i.e., size and shape) of the pattern;

(2) The screen pattern geometry may be distorted. The pattern may, for example, be stretched or narrowed in one or both dimensions, as indicated in FIG. 14*b*. Screen distortion may also occur in combination with pattern translation and/or rotation.

A certain measure of departure from the ideal must be expected in any production process. However, in this case, opportunities exist for eliminating or at least reducing the effect of such departures. These opportunities will now be reviewed.

Adjusting Faceplate Position To Correct For Translation And/Or Rotation Of The Screen Pattern If the screen is applied to the faceplate by off-set printing or a similar process, it is probable that the predominant error will be a positioning error along one axis, i.e., x or y, caused by imperfect indexing of the translatory motion of the faceplate with the rotary motion of the printing cylinder. Other position errors resulting from a lateral displacement or slight rotation of the faceplate with respect to its nominal position in the printing press are also possible. On the other hand, there may be no significant distortion of the screen pattern geometry, so that repositioning the faceplate in the assembly machine would be all that is required.

Conceptually, the simplest approach is to follow the assembly procedure previously described in connection with FIG. 13, but to correct for any positioning errors of the screen pattern, i.e., translation or rotation with respect to its standard position, by adjusting the position of the panel before inserting it into the assembly machine, or at least before the mask is welded to support structure 3A. Methods for doing so are described in the following.

One method employs a modified form of the universal holding fixture 30 previously described in connection with FIG. 2. The modified fixture 400 is shown in FIG. 15 and defines a receptacle for receiving a faceplate (front panel). The fixed half-balls 22*a*, 22*b* and 22*c* of FIG. 2 are replaced in fixture 400 by adjustable half-balls 401*a*, 401*b* and 401*c*. Each of these half-balls is shown as being mounted at the end of a micrometer screw 402 which may be rotated by an individual stepper motor 404 through worm gears 406. By selectively adjusting the positions of the three half-balls, a contained faceplate may be moved with respect to fixture plate 416 so as to bring the screen pattern into a predetermined position with reference to the fixture plate.

The procedure based on this approach is to load a faceplate into holding fixture 400, insert the loaded fixture into a screen-inspection machine (to be described in connection with FIG. 16), have that machine adjust the three half-ball settings so that the screen is correctly positioned, and then insert the loaded fixture into the assembly machine where the mask is positioned and stretched to conform to a standard pattern in position and geometry; the mask is then welded to the support structure. This assembly machine is essentially the same as the one depicted by FIG. 13, except for such modifications are are required to accept and precisely locate fixture plate 416 instead of a faceplate.

To ensure stable and precise seating of each faceplate within fixture 400, the fixture comprises vertical stops 408*a*, 408*b* and 408*c*, and three leaf springs 410 to press the plate against the vertical stops. Leaf springs 410 may be rotated about pivots 412 to permit insertion of the faceplate 413 from below through rectangular opening 414 on the fixture plate 416. To ensure that the faceplate makes contact with all three half-balls, O-shaped leaf spring 418, mounted on post 420, presses against one corner.

Figure 16:
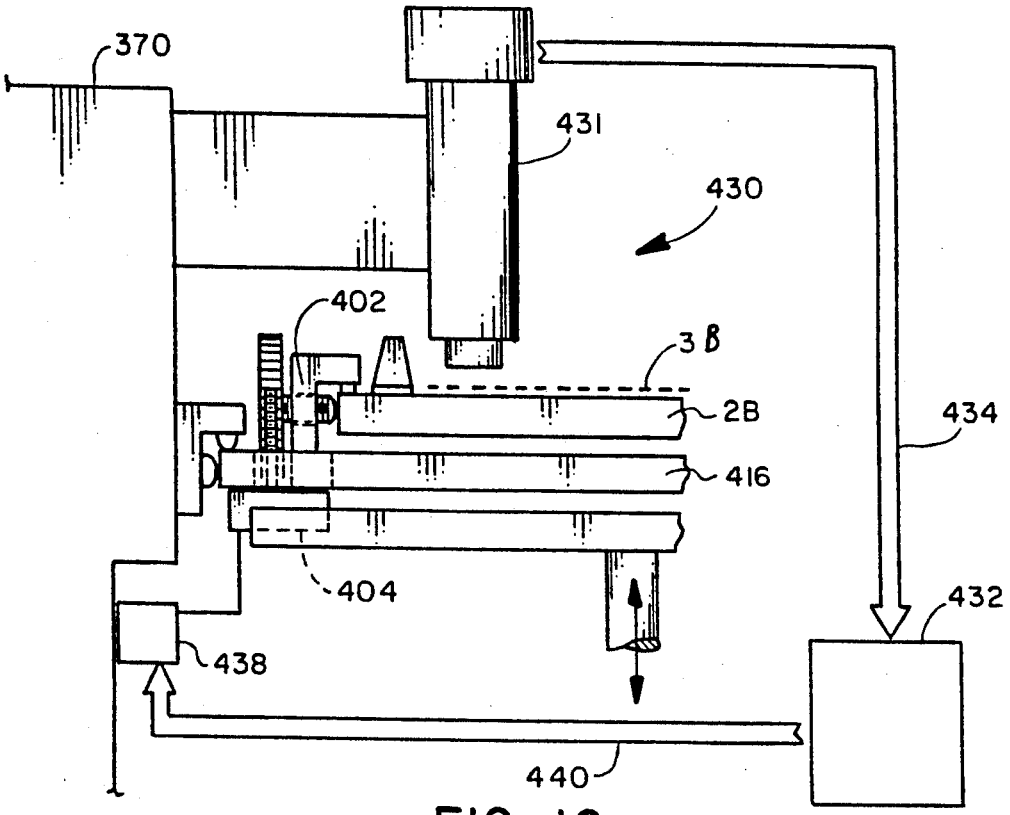
FIG. 16 is a view in elevation of a representative section of a screen inspection designed to receive the adjustable fixture depicted in FIG. 15, and of a feedback loop for adjusting that fixture.

In operation, a faceplate is loaded into fixture 400, locked in place by rotating leaf springs 410 to the position shown, and the fixture is inserted into screen inspection machine 430 depicted in FIG. 16. Grille position errors dx and dy are measured at a number of points. From the measured data, required adjustments of the three micrometer screws 402 are computed, and appropriate pulses transmitted to the three stepper motors 404. Inspection of any residual positioning errors remaining after this first adjustment may call for further adjustments; a feedback or servo loop exists here, permitting very precise adjustment of the faceplate position. This loop is indicated in FIG. 16, which shows schematically a screen inspection machine 430 designed to accept fixture 400 shown by FIG. 15, a computer 432 to convert position error signals 434 from sensor 431 (which may comprise a video camera) to stepper motor pulses 440, a connector 438 to connect the computer output to the three stepper motors 404, and micrometer screws 402 to adjust the position of the faceplate. As previously explained, the adjusted fixture is then mated to a mask in an assembly machine generally constructed as shown in FIG. 13, except that this machine is equipped to handle fixture plate 416 rather than the faceplate.

Figure 17:
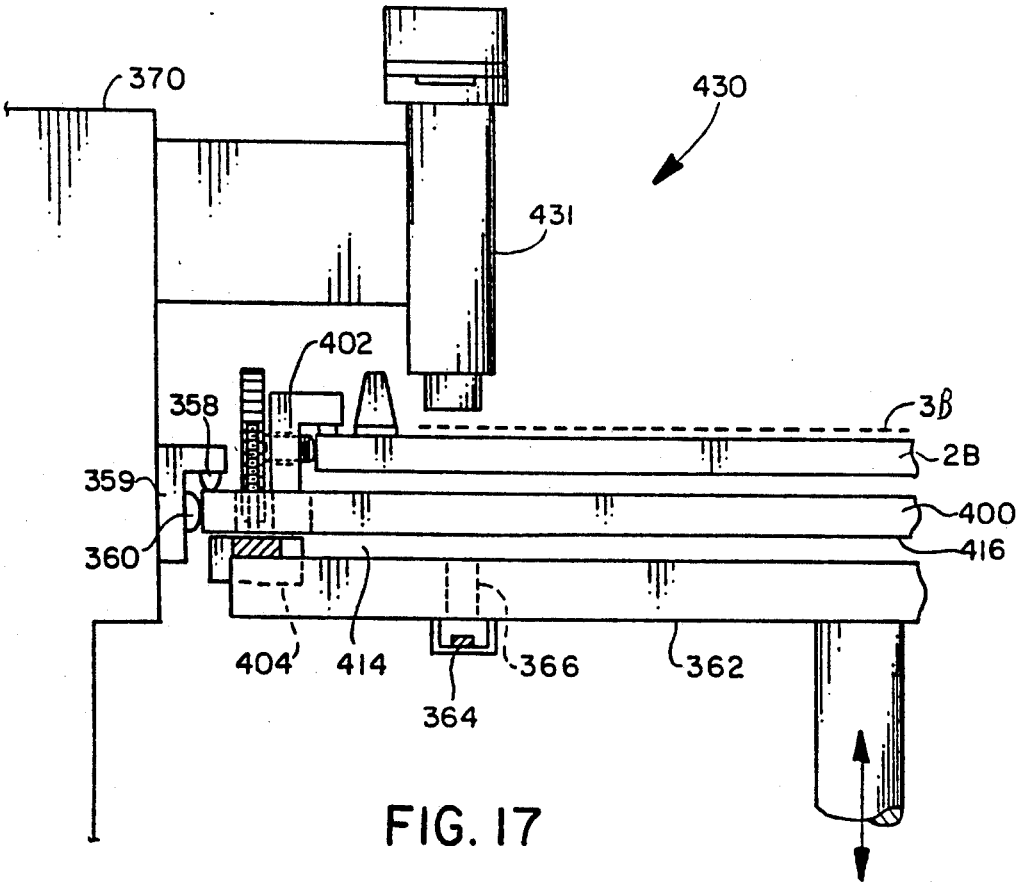
FIG. 17 is a more detailed view in elevation of a representative section of the same screen inspection machine.

FIG. 17 shows one version of a screen-inspection machine in detail. This version can be used if, at the time of inspection, no aluminum film has been applied to the screen, or if the points to be measured, typically on the periphery of the viewing area, were masked off during application of the film, so that they remain unobscured. Faceplate 2B carrying grille 3B is locked in holding fixture 400 which in turn is inserted into inspection machine 430, lifted by table 362 and pressed upward against vertical stops 358 as well as laterally against half-balls 360, both mounted on brackets 359 (only one bracket is shown). Light sources 364 mounted on the lower face of table 362 illuminate small selected regions at the periphery of the grille through holes 366 in the table 362 and rectangular opening 414 in fixture plate 416. Video-camera-equipped microscopes 431, firmly attached to the frame 370 of machine 430, develop patterns corresponding to the grille configuration in the small selected region.

FIG. 18*a* shows, greatly magnified, the pattern representing one corner of the grille as seen by the video camera. In FIG. 18*a*, one horizontal scanning line 367 is marked; the corresponding output signal is shown in FIG. 18*b*. Other horizontal scanning lines will produce wider or narrower pulses, depending on where they cross the grille apertures. From the start and stop time of each pulse, the horizontal coordinates x of the hole centers can be calculated, and by using many scanning lines, readings can be averaged to reduce error. Similarly, the vertical scan produces the sharp-edged pulses shown in FIG. 18*c*, thus providing information regarding the vertical coordinates y of the grille holes.

Computer 432 (FIG. 17) accepts this information, calculates the required adjustments of the three micrometer screws 402, and generates the appropriate pulses to stepper motors 404, as previously explained. This cycle may be related until residual errors are reduced below a predetermined tolerance level.

A different version of the screen inspection machine 430 shown by FIG. 17 must be used if the screen is fully aluminized at the time of inspection, so that even the peripheral portions of the grille are obscured. It then becomes necessary to inspect the grille from the outside, i.e., through the faceplate. For this purpose, fixture 400 shown by FIG. 15 may be inverted before insertion into machine 430; light sources 364, shown in FIG. 17, are replaced by light sources placed near video cameras 431. Video cameras 431 observe the grille through the full thickness of the faceplate 416. Faceplate thickness may vary, and the focus of the video cameras 431 must be adjusted to compensate for such variations. This may be done by a conventional automatic focusing system, or by a mechanism designed to sense the screen surface and arranged to respond to an increment S in faceplate thickness by retracting the cameras 431 by $S(n-1)/n$, where n is the refractive index of the faceplate glass.

Another method for correcting screen pattern position errors avoids the use of a special holding fixture; the faceplate is directly inserted into the screen inspection machine depicted in FIG. 19. It will be noted that most of the important features of this machine 530, i.e. vertical stops 558 and half-balls 560, table 562, light sources 564, hole 566, and video camera 531, have their counterparts in FIG. 17. The significant difference is the absence of holding fixture 400 and the adjustable stops with their micrometer screws 402 and stepper motors 404. In addition, stops 558 and half-balls 560 are designed to accept the faceplate rather than the larger fixture plate 416.

Screen positioning errors are measured in machine 530 just as previously described in connection with machine 430 (FIG. 17), and micrometer adjustments required to correct for these errors are computed. However, in this case, no feedback loop exists; instead, the correction information is stored in the computer for later transfer to the assembly machine.

The assembly machine is a modified form of the machine shown by FIG. 13. The modification consists in the fact that half-balls 222 have been made adjustable, as shown in the detail view, FIG. 20 (this figure should be compared with FIG. 13*f*). Half-balls 380 (only one is shown), are mounted on micrometer screws 382 which may be adjusted by stepper motor 384 through gears 386 and 388.

Figure 20:
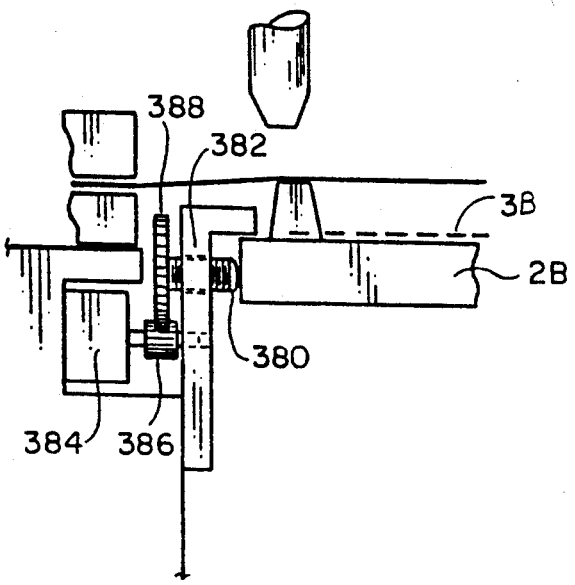
FIG. 20 is a detail view in elevation of a modified form of the assembly machine depicted in FIG. 13.

Before inserting a faceplate into the modified assembly machine indicated in FIG. 13, as modified in FIG. 20, the stored correction data for the faceplate is transmitted to stepper motors 384. Thus, when the faceplate is inserted into the assembly machine, the screen is in the correct position. A mask positioned and stretched to conform to a standard position and geometry is therefor joined to this faceplate without any further measurement, and registry of apertures and screen patterns result.

The use of a separate machine dedicated to screen inspection makes it possible to attach the position sensors—for example, video cameras 431 or 531—rigidly to frame 370 or 570 of that machine (see respective FIGS. 17 and 19), thus ensuring good reproducibility of the measurements. The faceplate or holding fixture can be inserted and removed without having to move the sensors out of the way.

It is, however, also possible to inspect the screen in an assembly machine. This alternative eliminates the need for a separate screen inspection machine and the associated extra handling of the faceplate, at the price of greater complexity and a slower working cycle for the assembly machine, brought about by the additional operations which must now be performed in that machine.

An example of such a machine is illustrated in FIG. 21. This figure shows an assembly machine which comprises the basic features of the machine depicted in FIG. 13, modified to include adjustable half-balls 380 as shown in FIG. 21 for adjusting the position of the faceplate, and further modified to include optical sensors for observing not only the mask but also the grille.

FIG. 21*a* depicts two similar gate-like structures 320*a* and 320*b* mounted above and below baseplate 321 (shown by FIG. 21*b*) of assembly machine 318, which, as noted, is generally analogous to the machine depicted in FIG. 13. Structures 320*a* and 320*b* consist of crossbars 322*a* and 322*b* which are supported by columns 324*a* and 324*b* fastened to baseplate 321. A faceplate 330 with support structure 332 is shown inserted into the machine, and a mask 333 is under tension by virtue of the forces exerted by pull-rods 334 upon clamps 356.

Cross bars 322*a* and 322*b* are equipped with extensions 336 which carry precision bearings 338. A cylindrical shaft 340 is free to rotate within these bearings. Two optical devices 342 and 344 are firmly mounted on this shaft by means of bars 346 and 348 and outriggers 350 and 352. They can be swung out of the way for the purpose of mask and faceplate insertion, welding and removal, or they may be moved into the position illustrated, where bar 348 contacts half-ball 354 which is attached to one of the columns 324*b*.

Each of the optical devices 342 and 344 comprise a light source and an optical sensor. For example, device 342 may contain means for projecting a convergent hollow cone of light through the mask toward the aluminized inside surface of the screen so as to form a brightly illuminated spot on the inside of the mask after reflection by the film. The optical sensor in device 342 may be composed of a combination of focusing lens and quadrant detectors similar to elements 149 and 89 of FIG. 13*d*, for the purpose of measuring position errors in x and y of a predetermined mask aperture, and for developing error signals related to such position errors.

Optical device 344, on the other hand, has the task of measuring position errors in x and y of the grille at a predetermined location. It is assumed here that the grille at this location is obscured by the aluminum film, hence back-lighting may not be practical. Device 344, therefore, may contain means for illuminating a portion of the screen from the front, as well as a sensor, which may be a quadrant detector equipped with a focusing lens, but which preferably is a microscope with a video camera. As previously explained, the optical sensor in device 344 must be designed to compensate for variations in faceplate thickness, either by being equipped with an automatic focusing system, or by means of a mechanism designed to sense the screen surface.

The operation of assembly machine 318 is analogous to the procedure described previously in connection with the separate screen inspection machine (FIGS. 17 and 19): grille position information from the sensors of optical devices 344 (equivalent to sensor 431 in FIG. 16) is fed to a computer (equivalent to sensor 432 in FIG. 16) which calculates the required corrections of the three half-balls (380 in FIG. 21) and supplies appropriate pulses to stepper motors 384 so as to adjust micrometer screws 382 through gears 386 and 388. This is a closed feedback loop, analogous to the one shown in FIG. 16; repeating the cycle causes the error in screen position to be reduced below a predetermined tolerance level.

Quite independently of the adjustment of the faceplate position just described, mask 333 is monitored by the sensors of optical device 342 and stretched, as well as positioned, by clamps 356 driven by servo motors (not shown) through pull rods 334, in the manner previously explained, until the mask conforms to an established standard position and geometry. As soon as faceplate and mask adjustments have been completed, optical devices 342 and 344 are swung out of the way; the mask is then welded support structure 332, the excess material cut, and the assembly removed from the machine in the manner described in connection with FIG. 13.

Adjusting Mask Position To Correct For Translation And/Or Rotation Of The Screen Pattern In the preceding part of this specification, methods were outlined for determining the departure of the grille (screen) from its nominal position, and for using this information to move the faceplate so that before the mask is welded to its support structure in the assembly machine, the grille is in its nominal position. There exists, however, an alternative way of using that same information. It is best illustrated in an example.

Let it be assured that the screen is inspected in the machine shown in FIG. 19, and that the sensors find the grille displaced to the right by three mils, and upward by one mil, with 0.2 milliradians of clockwise rotational error. Following the procedures previously described, the micrometer screws in fixture 400 (FIG. 15), or in the assembly machine (FIGS. 20 or 21) would have been adjusted to move the faceplate three mils to the left and one mil down and rotate it counter-clockwise by 0.2 milliradians in order to bring the grille into its nominal position. But the same final result would have been obtained without making any mechanical adjustments to the faceplate, by moving the properly stretched mask three mils to the right and one mil up from its nominal position and rotate it clockwise by 0.2 milliradians. This can be done, for example, by first permitting the mask-stretching servo motors to position and stretch the mask to conform to the predetermined standard position and geometry, then disabling the servo loops and supplying appropriate input signals to the motors to displace the mask in an open-loop mode as required, without changing its size, shape or tension, i.e., while maintaining its geometry.

Another possibility lies in mounting all servo motors on a rigid carrier which is capable of being displaced as a whole, and applying the position correction to that carrier. This is illustrated in FIG. 25 which shows an assembly machine 600 including a frame 602, three half-balls 604 (only one of which is shown), and three vertical stops 606 (only two of which are shown) for locating faceplate 608, and a vertically movable table 609 for pressing the faceplate against the vertical stops. Frame 602 has plane top surfaces 610 which support frame-shaped carrier 612 through steel balls 614. Stepper motors 616 for stretching mask 618 through pull rods 620 and clamps 622 are all supported on the top surface of carrier 612.

The height of carrier 612 above the plane top surfaces 610 of frame 602 is precisely controlled by the steel balls. Its horizontal position may be adjusted by three micrometer screws 612 (only one is shown) which are controlled by stepper motors 626 through reduction gears 627 and 628. Only one stepper motor is shown, but three are required to uniquely define the horizontal position of the carrier; a compressed spring 630, shown schematically, ensures continuous contact between the tips of the three micrometer screws 624 and carrier 612.

To simplify the drawing, FIG. 25 shows no optical devices. Also, the horizontal dimension of the mask is shown reduced so that both sides of carrier 612 can be illustrated.

Figure 22:
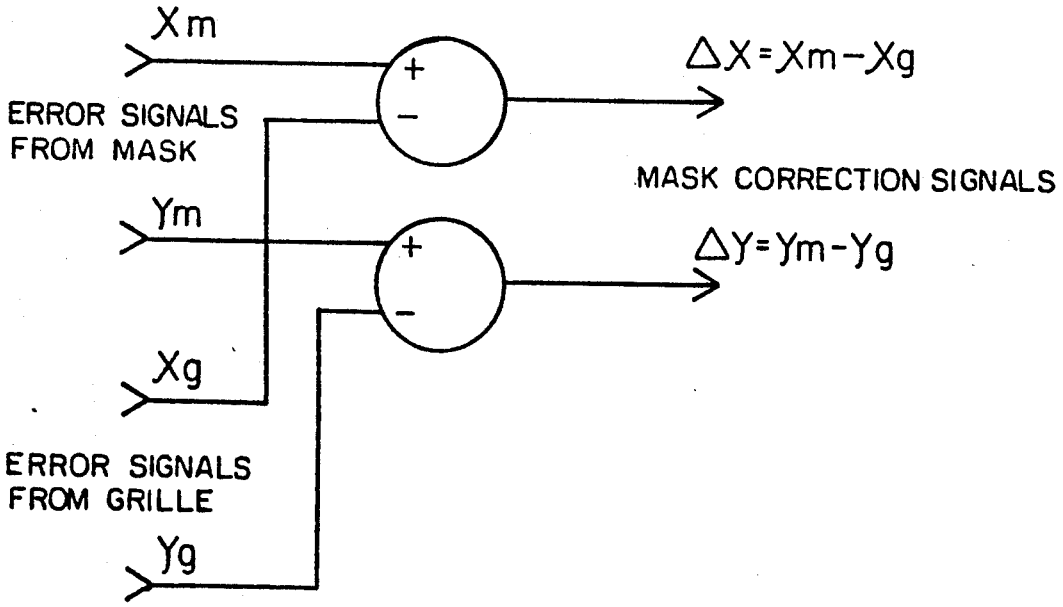
FIG. 22 is a schematic diagram of a difference-forming circuit for controlling servo motors.

It is also possible to use the information from the screen inspection machine to bias the feedback loops which control the mask servo motors. This approach is illustrated in FIG. 22 for the case of analog signals. It is essential that both error signals are linear functions of the positioning errors, and that a given voltage corresponds to the same error for both sources (mask and grille). It will be obvious that a digital version of this circuit is also possible. In any case, the servo motors will move until the difference signal Xm - Xg, or Ym - Yg, is reduced to zero.

The three approaches just outlined have in common the principle that the mask is moved from its standard position to make up a displacement of the grille. In all three cases, the mask is stretched to conform to a standard position and geometry and is also displaced. In the first and second approach, these two operations are carried out separately; in the third approach, they are merged. In all three cases, the instructions for the additional displacement come from a separate screen inspection machine, and there is no need for moving or looking at the faceplate in the assembly machine. Therefore, the assembly machine can take the simple form illustrated in FIG. 13, except for the addition of a laterally movable carrier for mounting the servo motors in the case of the second approach.

The methods described up to this point are all based on the assumption that the grille (screen) may be displaced from its nominal position, but that it has the correct size and shape, so that a mask stretched to conform to the standard geometry will always fit the grille, provided only that any relative displacements are corrected.

Adjusting Mask Shape To A Particular Screen

The possibility of screen patterns being too large or too small, or having distortions such as indicated in FIG. **14*b***, cannot be ruled out. It is in the nature of the stretchable mask that it can compensate for small departures from the correct size an shape of the grille pattern. But to take advantage of this characteristic, the principle of stretching the mask to conform to a predetermined standard position and geometry must be replaced by the idea of stretching it to conform to an individual grille. When a screen inspection machine measures more than two points (for example, the four corners) on a displaced but undistorted grille, certain geometrical relationships exist between the measured data. For example, the horizontal displacements of the two upper corners are the same. Three independent measurements (for example, the vertical displacement of each upper corner and their common horizontal displacement) suffice to specify translation of the upper edge in x and y, as well as rotation. Measuring x and y displacements of all four corners provides welcomed redundancy, which permits more accurate computation of the translational components of a chosen point (e.g., the center of the rectangle) as well as the rotation, using simple algorithms.

If the screen is not only displaced but also distorted, these algorithms can still be used to compute the translational and rational components for the purpose of moving the faceplate or the mask to achieve compensation; but of course; such compensation will not be perfect because the distortion component is still present.

On the other hand, the last approach outlined in the preceding section, where the feedback loops are biased in accordance with grille position error signals derived from the screen inspection machine, will automatically cause the mask to depart from the standard geometry and to be stretched so as to at least partly compensate for screen distortion. Suppose, for example, that the grille is distorted as indicated in FIG. **14*b***, i.e., too long in the horizontal direction; then the horizontal displacements of the two upper corners will not be alike, the right top corner yielding a larger positive (or smaller negative) value of Xg than the left top corner. The two bias voltages (or digital bias signals) supplied to the left and right servo motors will therefore be different, causing the motors to come to rest in positions which stretch the mask more than the usual amount to compensate for the excess length of the grille.

The procedure just described represents an intermediate step between stretching the mask to conform to a standard position and geometry, and stretching it to conform to an individual grille.

The mask is stretched to conform to the standard, but grille information is fed into the feedback loops to correct for the particular grille. This seems a roundabout approach, and it raises the question to what extent a standard is really needed in this embodiment.

FIG. 23 shows an assembly machine which is a simplified version of the machine shown in FIG. 21.

The adjustable half-balls 321 included in FIG. 21 are replaced by fixed half-balls. In the design of the upper sensors of optical device 342, which measure mask position errors with reference to a mask standard, and lower sensors of optical device 344, which measure grille position errors with reference to a grille standard, care is taken to make sure that equal position errors produce equal error voltages (or equal digital signals) from both sets of sensors. The sensor outputs are then connected into the difference-forming circuit of FIG. 22, and the outputs from this circuit are used to control the mask servo motors. When the servos come to rest, the mask fits the grille—distorted or undistorted—as well as is possible with the mechanical limitations of the system.

The common mounting of a pair of sensors (342 and 344) on a rigid shaft 340 is advantageous because the output signal from the difference-forming circuit (FIG. 22) is not sensitive to simultaneous displacement of both sensors by equal amounts.

FIG. 24 indicates a more direct approach to developing error signals which indicate differences between mask and grille, by measuring the positions of selected points in the mask directly with reference to corresponding points on an individual grille. The arrangement of FIG. 24 modifies the assembly machine of FIG 13. No mask or grille standard is used. Specifically, FIG. 24 indicates a point-like light source 302, preferably a gallium arsenide diode laser, illuminating two round apertures 304 (shown greatly magnified in FIG. 24c) in the peripheral region of the mask near support structure 3a outside the viewing area. Light passing through the two apertures strikes the black grille 306. The grille has a rectangular window 308 so positioned that when screen and mask are properly aligned, one-half the light passing through each of the two mask apertures 304 will also pass through the window. FIG. 24c illustrates the case where the screen, and thus window 308, is displaced to the left; as a consequence, more light from the left aperture than from the right now passes through the window. A balanced photodetector 310, consisting of two separate photodetectors connected in push-pull, is placed below the faceplate to develop an electrical output indicative of the unbalance, thus producing a position error signal. No difference-forming circuit of the type shown in FIG. 22 is needed here, since a difference signal is produced directly by the optical arrangement shown in FIG. 24.

The size of aperture 304 of window 308 depends on the magnitude of the expected initial screen-positioning errors of the mask relative to the grille. Space along the edge of the viewing area is a premium; therefore, the apertures and window should not be made larger than necessary. A lower limit for the aperture size is set by the appearance of diffraction effects which tend to blur the shadow of the aperture edge on the grille.

If there is not enough space available between the viewing area and supporting structure 3A, apertures 304 and window 308 may be placed outside support structure, as shown in FIG. 24b. The mode of operation is the same as that discussed in connection with FIG. 24a.

FIGS. 24a and 24b show the beam of light from source 302 striking apertures 304 under angle $\alpha$. It is preferred to make this angle, or at least its projection on a plane which contains the light source as well as the centers of apertures 304, substantially equal to the corresponding angle formed by the incident electron beams in the completed tube. This has the advantage that errors in the height of support structure 3A are compensated for; for example, if the support structure is too low, the shadow of apertures 304 will move to the right as shown in FIG. 24c and produce an error signal which calls for additional stretching of the mask.

The assembly procedure is analogous to that described in connection with FIG. 13, with the following changes:

In the step depicted in FIG. 13c, a bottom plate is substituted for the optics-equipped plate 91, simply to support the mask before it is clamped. After clamping, the bottom plate is withdrawn, a faceplate is inserted as in FIG. 13f; the optical components (which had to be moved out of the way to insert mask and faceplate) are put in their proper positions and the servo circuits are turned on. All mask positioning and stretching is done with reference to the grille; the clamp motors are controlled by the signals derived from balanced photodetectors 310, either individually (one motor—one photodetector), or preferably, collectively through the matrixing process described in connection with FIG. 12.

It was mentioned earlier that simple algorithms exist for extracting the translational and rotational components from measured displacements at selected points. This applies whether the displacements refer to mask vs. standard, grille vs. standard, or mask vs. grille. In all cases, the translational and rotational components may be compensated for by displacing the mask, the grille, or both. More specifically, the mask may be moved entirely by activating the clamping motors, or by mounting these motors on a carrier capable of translation and rotation in the x-y plane for mask position adjustments. The grille may be moved by the micrometer screws illustrated in several embodiments, or by other means capable of translating and rotating the faceplate in the x-y plane. These operations may be carried out in a closed-loop or open-loop mode. Selection of a particular combination is a matter of design choice.

In the foregoing, it has been shown how a mask may be positioned and stretched so that its pattern attains a desired relation to a screen. The above discussion includes:

I. Stretching and positioning the mask, and positioning the screen, to conform to a common standard A. If the screen is shown to be undistorted (that is, to have a "standard" geometry) and correctly positioned on the panel, by positioning and stretching the mask to conform to the predetermined standard mask position and geometry;

B. If the screen is known to be undistorted but not necessarily correctly positioned on the panel, by—

1. providing an adjustable fixture (FIG. 15) for handling the panel which is independent of the assembly machine, inspecting screen position in a separate screen inspection machine (FIG. 17) and, through feedback (FIG. 16), adjusting the fixture, or—
2. providing adjustment capability in the assembly machine (FIG. 20), with the information required to make the adjustment derived—
   a. from a separate screen inspection machine (FIG. 19), or— b. from screen inspection performed in the assembly machine itself (FIG. 21).

In all these cases, the panel is moved to correct for screen position errors, and the mask is positioned and stretched to conform to a standard position and geometry.

II. Conforming the mask to the screen

Another class of solutions shares the common feature that the mask is positioned and stretched—not to conform to a standard, but rather so as to reduce the differences between corresponding points on a particular mask and screen to a minimum (FIG. 22). This may be done by—

A. Inspecting the screen in a separate machine (FIG. 19) to measure screen departures (Xg) from a standard position and geometry; in the assembly machine, measure mask departures (Xm) from the standard position and geometry; move and stretch mask to minimize Xm - Xg (FIG. 22).

B. Inspecting mask and screen simultaneously in an assembly machine; reduce difference between corresponding points to the minimum. This may be accomplished:

1. Separate optical systems may be employed to measure mask and screen position (FIG. 23), with the difference formed electronically (FIG. 22), or—
2. A single optical system joining mask and screen may be used, with the difference formed optically (FIG. 24). No standard reference is used.

A number of approaches for eliminating or alleviating the effect of screen errors have been described. It will be understood that these alternatives are comprised of individual steps which permit other combination in addition to those described.

FIGS. 26 to 29 Mask Clamping Sequence

A mask clamping sequence is illustrated in FIGS. 26 to 29, and it should be understood that this sequence can be utilized with any of the embodiments illustrated in this application.

Figure 26:
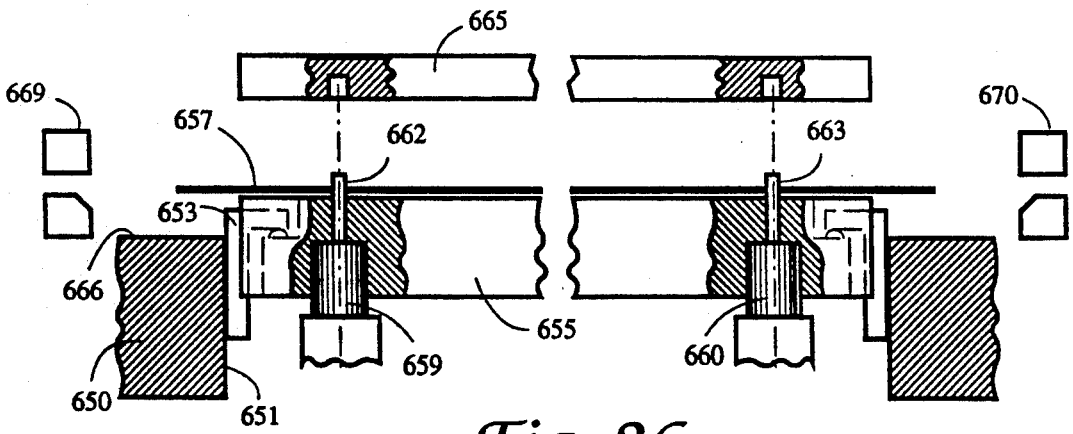
FIGS. 26 to 29 are sequential views of a typical stretching system showing mask positioning, clamp advancement and clamp engagement, according to the present invention.

Viewing FIG. 26, a stretching platform 650 has a rectangular aperture 651 therein in which vertical and horizontal registration elements 653 are mounted, usually three, that receive and register a mask support 655 that may also be utilized to support mask 657 during transit from a loading station. The mask support 655 has a pair of pneumatic actuators 659 and 660 that extend and retract pins 662 and 663 through apertures in mask 657 preferably positioned midway in the side border areas of the mask. Alternatively, pins 662, 663 may be fixed to mask support 655 which is raised and lowered to the proper height.

At the loading station, the pins 662 and 663 are extended to the positions illustrated in FIG. 26 to facilitate placement of the mask 657 on support 655, and these pins remain extended until after the mask is clamped.

After the support 655 is registered at the mask stretching and screen registration station, which station is depicted in each of FIGS. 26 to 29, an upper rectangular platen 665 is lowered into engagement with the mask assuring that the mask is flat and thereby assuring that the side edges of the mask are in their radial outermost positions for clamping.

It should be noted in FIG. 26 that the upper surface of the mask support 655 is substantially above upper surface 666 of the stretcher platform 650 so that the edges of the mask 657 are cantilevered over and spaced above the upper surface 666 of the stretcher platform to facilitate entry of clamp assemblies 669 and 670 illustrated schematically with the jaws open in FIG. 26. It should be understood that the clamps 669 and 670 are shown only schematically in FIGS. 26 to 29 and that in actual use and as shown in the other embodiments of this application, there are a plurality of clamps 669 and 670 on each side of the mask 657, and it should also be understood that the clamping assemblies operate simultaneously so this description with reference to clamping assemblies 669 and 670 applies to the remaining clamping assemblies as well.

Figure 27:
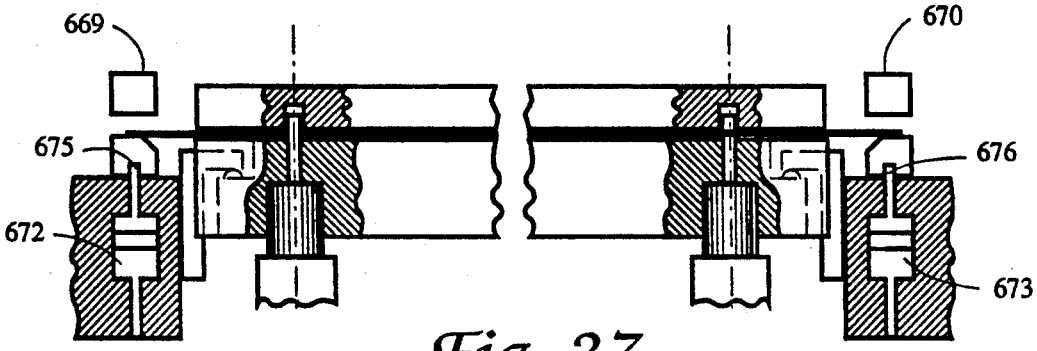
Figure 36:
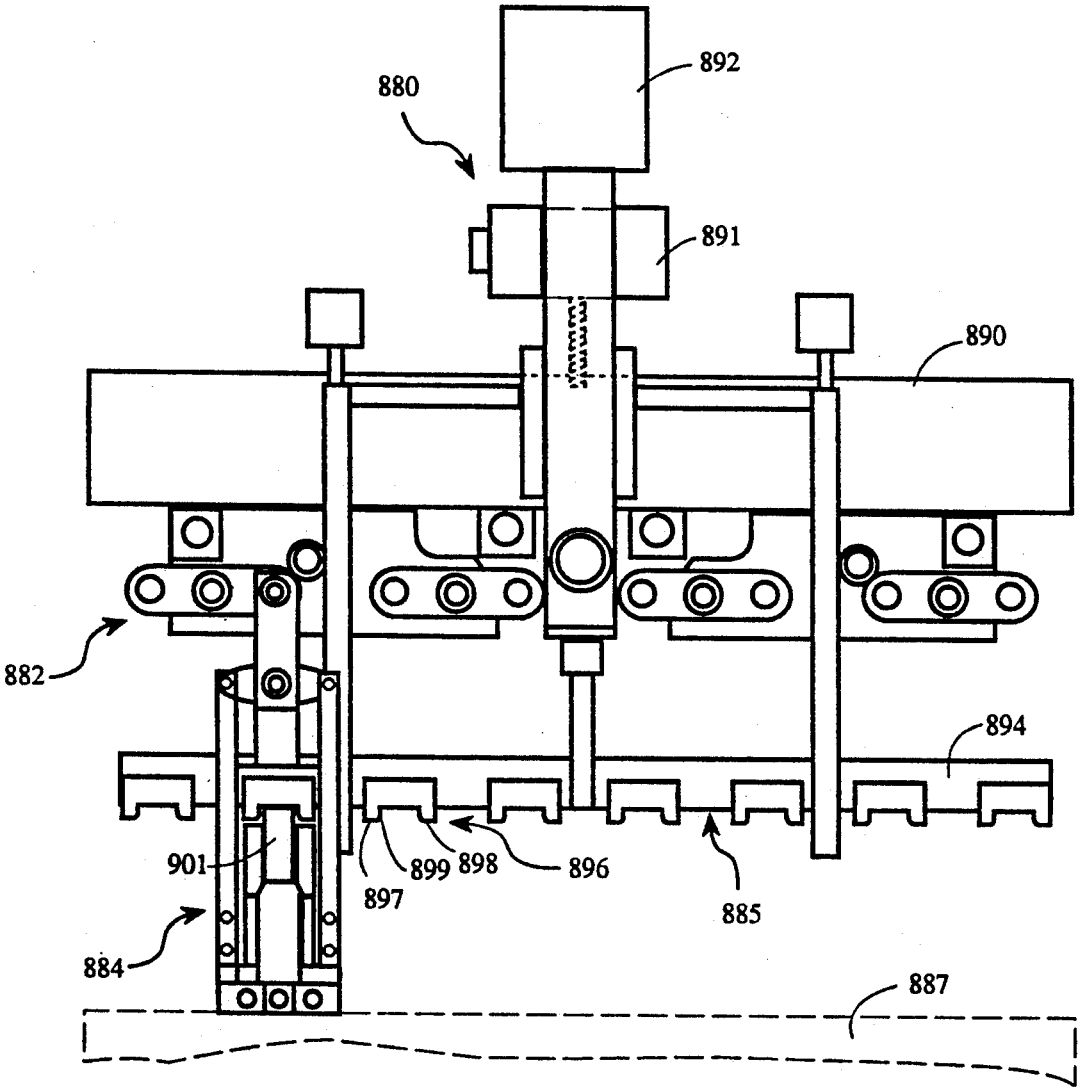
FIG. 36 is a top view of an "in line" wiffle tree system for applying and distributing forces to the clamping elements.

After the upper platen 665 is lowered, the clamping assemblies 669 and 670 are advanced simultaneously toward the mask 657, sliding on stretcher platform surface 666 until they reach the approximate clamp engagement positions illustrated in FIG. 27. A suitable alignment mechanism described below in connection with FIG. 36 is utilized to assure the clamps maintain their proper orientation with respect to one another during this advancement stroke.

It is extremely important that each of the clamps achieve a predetermined position just prior to clamping, and toward this end a plurality of pneumatic actuators 672 and 673 are carried by the stretcher platform, two for each of the clamping elements (although only one is shown for each clamp in FIGS. 27 to 29), and they extend and retract pins 675 and 676 into and from holes in the bottoms of the clamp assemblies 669 and 670. Two actuators and two pins are provided for each of the clamps 669 and 670 longitudinally spaced along the clamp.

Figure 28:
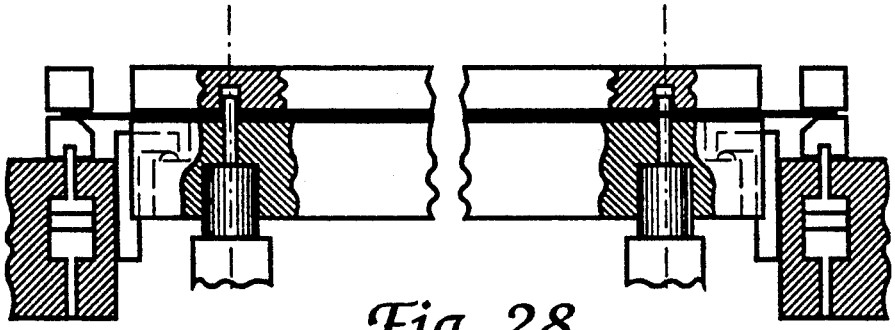

After the pins 675 and 676 are engaged in the clamps to precisely align them in a predetermined initial position, the clamps are engaged with the mask as illustrated in FIG. 28.

Figure 29:
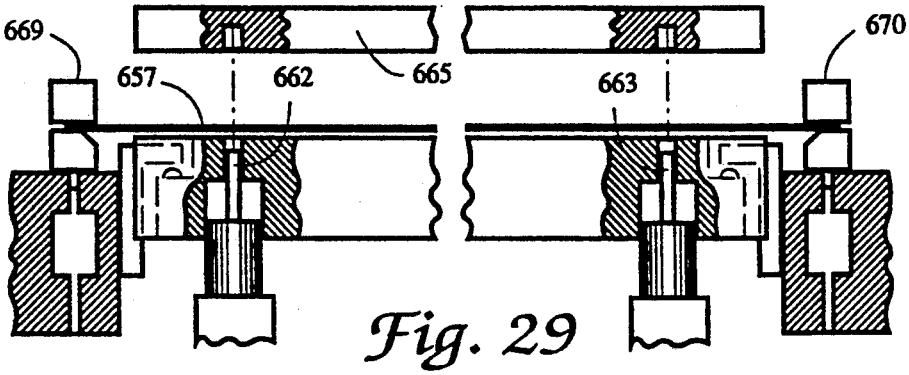

Pins 675 and 676 are then retracted from the clamps as shown in FIG. 29. At this time pins 662 and 663 are retracted from the mask 657 and upper platen 665 is raised, thereby completely freeing the mask 657 from any constraints other than those imposed by the clamping assembly 669 and 670. Mask support 655 is lowered and the stretching sequence then begins.

Stretching Control in FIGS. 30 to 33

In FIGS. 30 to 33 stretching arrangements are illustrated generally similar to FIGS. 8a, 12, 5 and 7, respectively, although in somewhat modified form and in some cases somewhat amplified.

Figure 30:
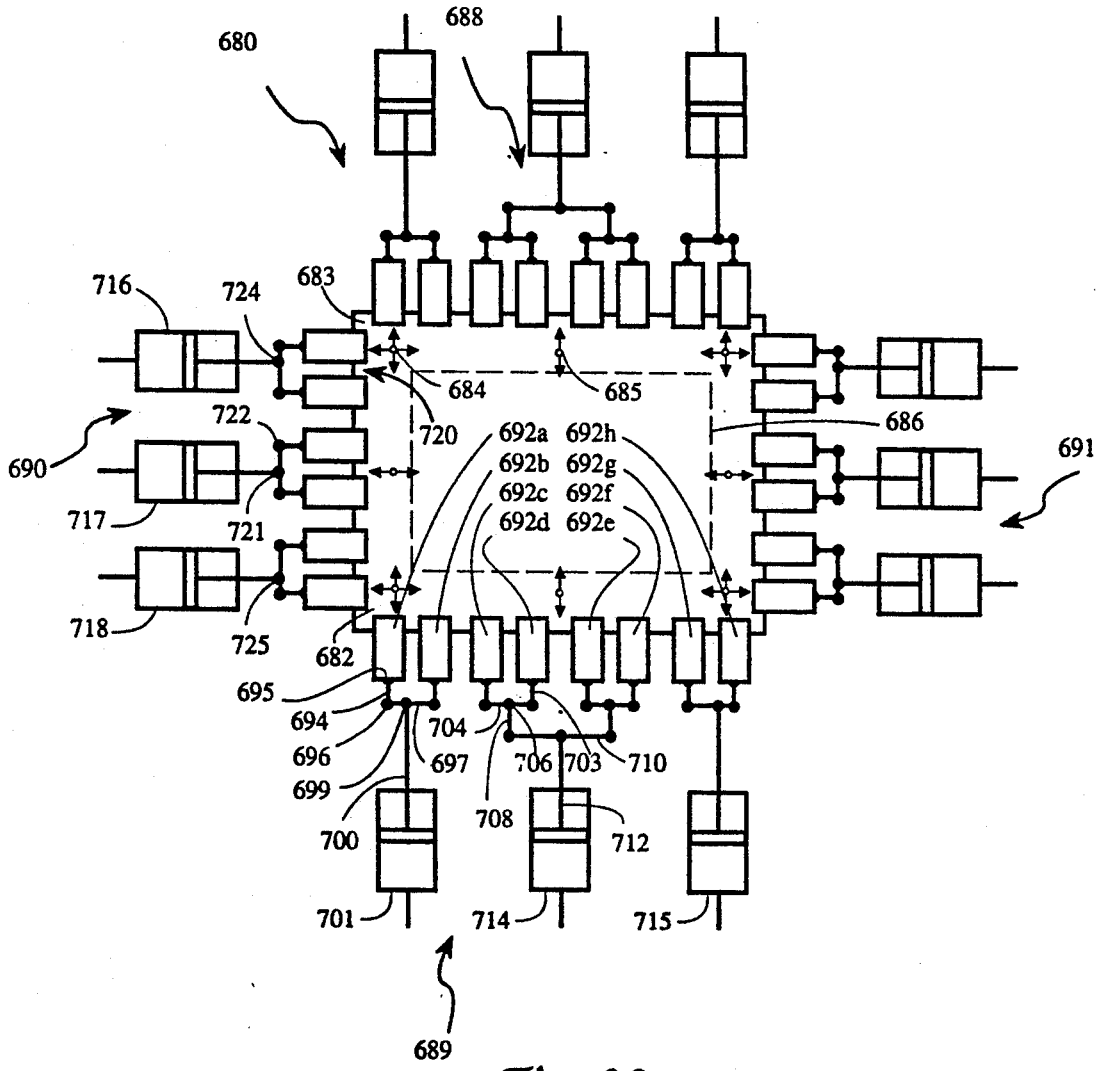
FIG. 30 is a top schematic view somewhat similar to FIG. 8*a* showing a combination of cross links and independent actuators for the clamping and stretching elements.

In FIG. 30, a twenty-eight clamp stretching system is illustrated that combines the effect of applying a predetermined ratio of stretching forces to clamping elements along each side and independently controlling stretching forces exerted by the clamping elements.

The fixed forced ratio control illustrated is particularly useful in compensating for mask configurations that are common to all masks, e.g. a denser border area than central array area. On the other hand the independent control of forces applied to one or more clamps is useful in compensating for mask or screen variations that are not common to all masks or screens and appear perhaps somewhat infrequently. For example, assume that the mask variation in question is a somewhat heavier material or foil thickness in the lower right quadrant of the mask, or for that matter any aberration that would produce a higher stress versus strain in the lower right quadrant of the mask or an elongation of the lower right quadrant of the screen. If this mask is to be properly registered, the lower right quadrant when compared with the other quadrants in the mask must have higher stretching forces applied to the adjacent stretching clamps to achieve registration. This capability is provided by the twelve independent and separately controlled actuators for the clamps illustrated in FIG. 30.

Referring to FIG. 30, a stretching system 680 is illustrated for stretching a rectangular foil mask 682 having a border area 683 with corner position apertures 684, mid-border position apertures 685 and a central rectangular array of apertures 686. Side clamping systems 688 and 689 are identical as are orthogonally related stretching systems 690 and 691 to one another, so that the description of one of each pair will be assumed to apply to the other of the pair as well.

Stretching system 689 includes eight equally spaced clamping elements 692 *a–h*, each of which has a radially outwardly extending link 694 pivotally connected to the clamping element at 695 at one end and pivotally connected at its other end at 696 to a cross link. Link 694 associated with clamp 692*a*, for example, is pivotally connected at 696 to cross link 697. This pivotal arrangement of outwardly extending links 694 accommodates the lateral movement of the clamping elements 692 as the mask grows during stretching.

Cross link 697 is pivotally connected at 699 to rod 700 of actuator 701. The offset of pivot 699 laterally to the left as illustrated in FIG. 30, causes a predetermined greater force to be applied to the left clamp 692*a* of the pair than to the right clamp 692*b*.

Clamps 692*c* and 692*d* have similar outwardly extending links 694 pivotally connected in the same manner to cross link 704 which in turn is pivotally connected at central pivot 706 to a second level outwardly extending link 708. Link 708 is in turn pivoted to a second level cross link 710 which applies forces through a mirror image linkage mechanism to clamps 692*e* and 692*f*.

Cross link 710 is pivotally connected at its center to actuator rod 712 associated with actuator 714.

Actuator 715 acts through a linkage which is a mirror image of that associated with actuator 701, to apply forces to clamps 692*g* and 692*h*.

The offsets of pivots 699 provide a fixed force ratio between the two clamps in the outer clamp pairs 692*a* and 692*b* and 692*g* and 692*h*. The four center clamps 692*c–f* have equal forces applied to each and because a single actuator 714 is provided for these, actuator 714 is normally controlled to provide a lesser force on clamps 692*c*, 692*d*, 692*e* and 692*f* than the forces applied to the outer clamps 692*a*, *b*, *g* and *h* to provide the desired force control ratio.

Thus, the desired force distribution is achieved by a combination of varying the forces applied by the actuators 701, 714 and 715 and fixed force distribution through the offsets of pivots in each interlinked clamp grouping.

Short side stretching system 690 includes three actuators 716, 717 and 718 each controlling a pair of clamps 720 through link systems similar to those associated with actuator 701 and 715 except that actuator 717 has its rod pivotally connected at point 721 centrally on link 722 so that equal forces are applied to the two middle clamps on each of the short sides.

In the six clamp systems, namely side systems 690 and 691, the two central clamps have equal forces applied thereto, the next adjacent outer flanking clamps have a higher force applied than the central two and the outermost clamps have a still higher force, on the order of 1.7 times the central two clamps 720. This force distribution is achieved by a combination of higher forces applied by actuators 716 and 718 compared to actuator 717 and the offsets of pivotal connections 724 and 725 between actuators 716 and 718 and their connected cross links.

By varying the forces, or more specifically the displacement, because the actuators are stepper motors; applied by actuators 701, 714, 715, 716, 717 and 718 from the predetermined values necessary to achieve the fixed ratio of forces between the clamps, the independent control described above can be achieved. For example, assuming the stress versus strain characteristics of mask 683 in the lower left quadrant of the mask is higher than elsewhere in the mask, this can be compensated by increasing the forces applied by actuators 701 and 718, and perhaps others, over the values necessary to achieve the above described predetermined ratio control, to increase the stress in the lower left quadrant and achieve the desired uniform strain across the mask.

Figure 31:
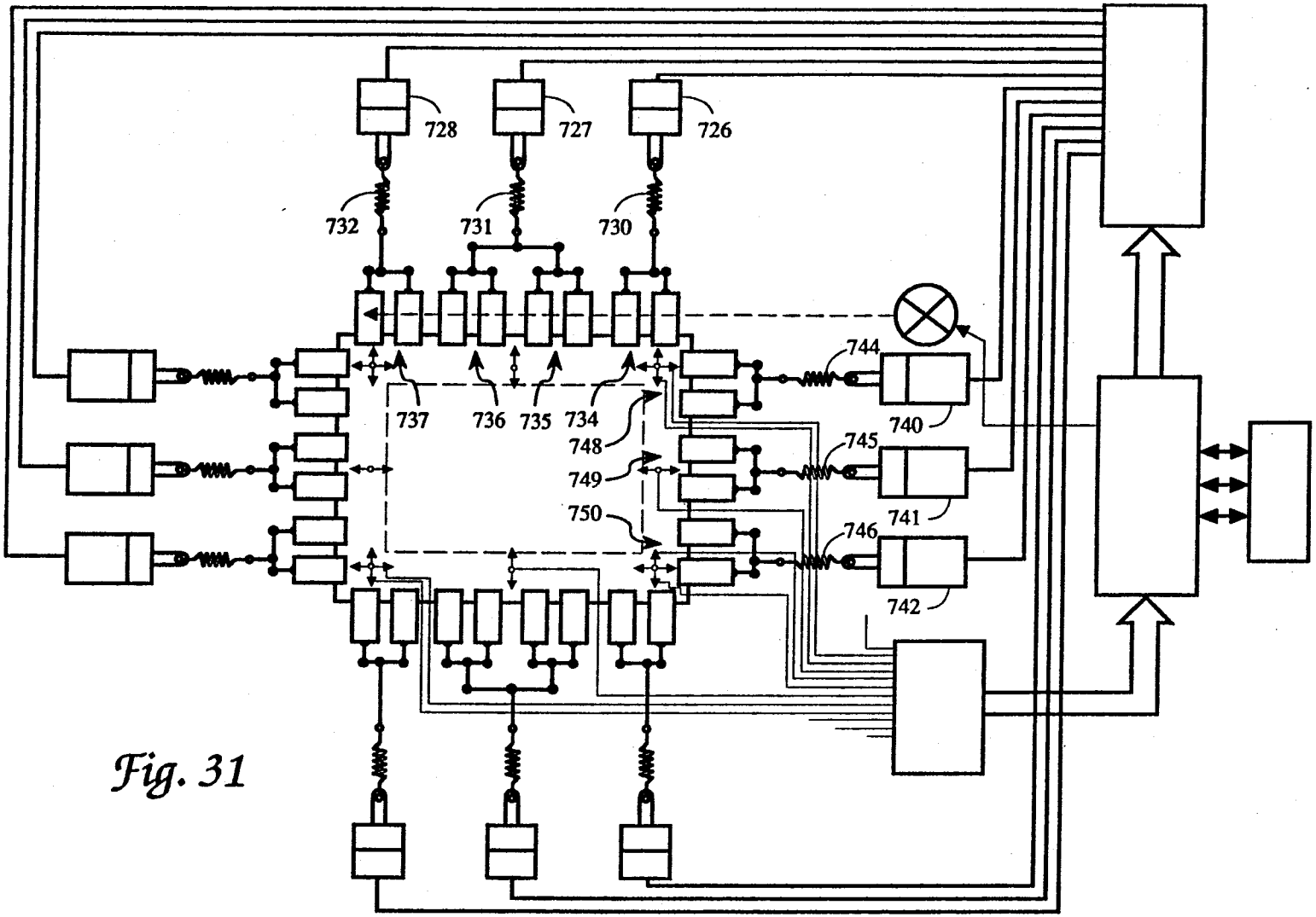
FIG. 31 is a top schematic view similar to FIG. 12 showing a combination of cross links and independent actuators for the clamping and stretching elements with optical feedback control.

The embodiment illustrated in FIG. 31 is generally similar to that shown in FIG. 30 except for the addition of fixed spring rate springs such as at 730, 731 and 732 between actuators 726, 727 and 728 and their associated linkage system and clamp pairs 734, 735, 736 and 737. Springs 730 and 732 have a higher spring rate than spring 731. Actuators 726, 727 and 728 are stepper motors so that with equal linear displacement of all three motors, springs 730 and 732 will exert greater forces on their clamps than spring 731 does to clamp pairs 735 and 736.

The interposition of fixed spring rate springs 730, 731 and 732 between the actuators and the linkage and clamp pairs provides further flexibility in achieving the predetermined ratio of forces exerted by the clamping pairs 734, 735, 736 and 737 on the mask. That is, in the FIG. 30 embodiment, it is necessary to provide greater displacements of actuators 716 and 718 than actuator 717 to accomplish the desired force distribution. By providing spring 731 with a spring rate lower than the spring rate of springs 730 and 732 by an appropriate value, the predetermined force distribution between the clamping pairs 734, 735, 736 and 737 can be achieved with equal displacement of motors 726, 727 and 728, of course with the appropriate offset of the cross links in clamp pairs 734 and 737.

Similarly, with the orthogonally related side stretching systems shown in FIG. 31, actuators 740, 741 and 742 act through springs 744, 745 and 746 to apply outward stretching forces to clamping pairs 748, 749 and 750. By providing spring 745 with a spring rate a predetermined value below that of springs 744 and 746, equal displacements of actuators 740, 741 and 742 will achieve the desired fixed force distribution between the clamps of clamping pairs 748, 749 and 750 again with the appropriate offsets of the cross links associated with clamp pairs 748 and 750.

Independent control of the clamping pairs is achieved by independently increasing or decreasing the displacements of one or more of the motors 726, 727, 728, 740, 741 and 742 from the displacement value necessary to achieve the desired force distribution between clamping pairs.

Figure 32:
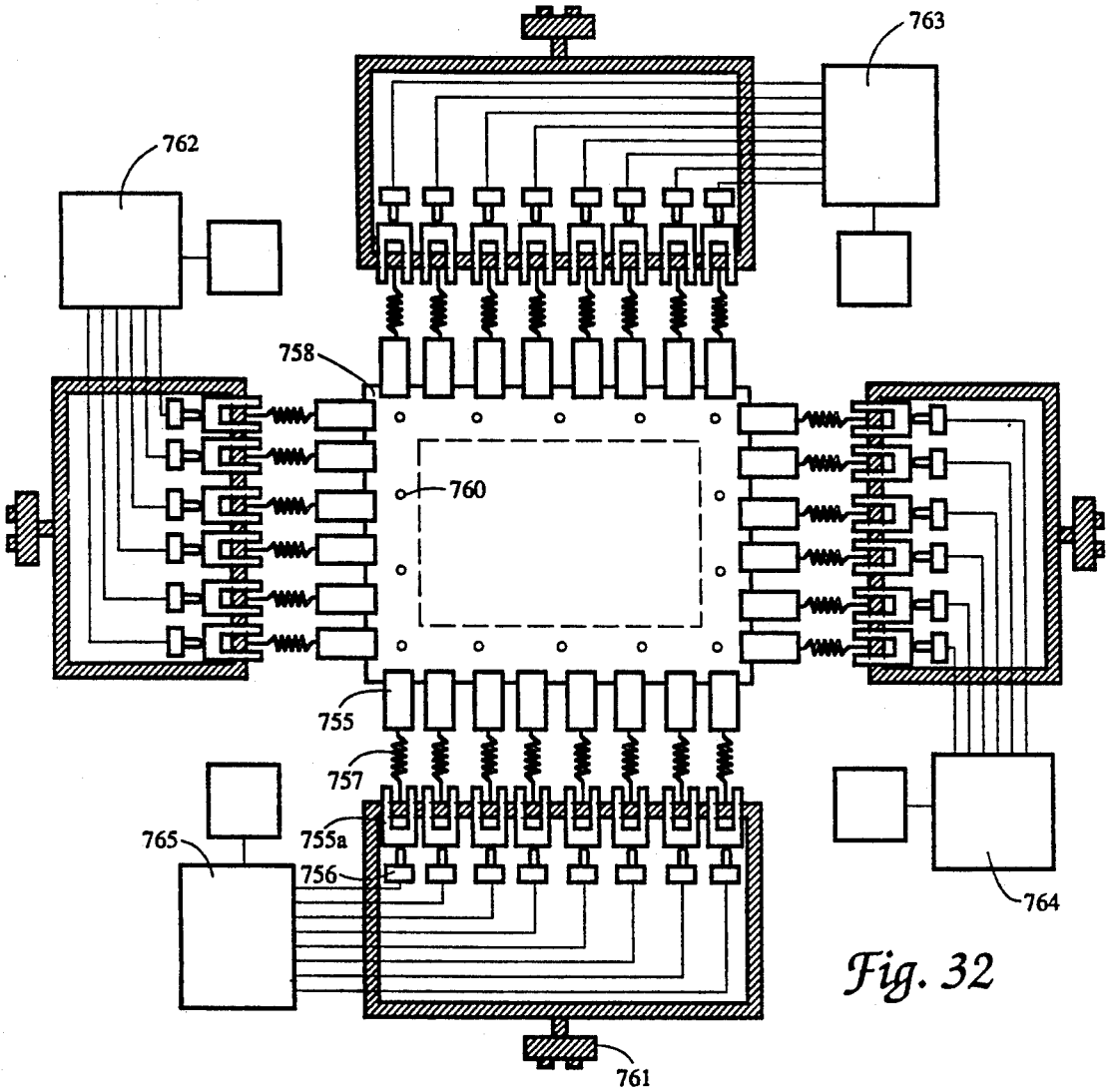
FIG. 32 is a top schematic view similar to FIG. 5 showing independent actuators and springs for each of clamping and stretching elements.

The stretching system illustrated in FIG. 32 has the basic attributes of those shown in FIGS. 30 and 31 i.e., fixed ratio stretching force distribution plus simultaneous or superimposed independent control, and it offers greater flexibility because each clamping element 755 is controlled through a separate actuator and spring arrangement.

Each of the clamping elements 755 is pulled to an individually adjustable stop 755*a* controlled by its own actuator 756. On each mask side a single large actuator 761 pulls all clamps 755 against their adjustable stops 755*a* through individual springs 757. Again, actuators 756 are stepper motors. The spring rate for each of the springs 757 around the perimeter of the mask is selected to achieve the desired ratio of forces between clamps 755 and it can be readily seen with this arrangement that a variety of stretching force ratios can be achieved. That is, with equal displacements of all actuators 756, the springs 757 solely determine the fixed ratio of forces applied to the mask.

To achieve the independent control described above with respect to FIGS. 30 and 31, the fine posistioning, or ultimate displacement, of each clamp 755 is controlled through the movement of its adjustable stop 755*a* by adjustment of the individual actuator 756. It can readily be seen because each adjustable stop 755*a* has its separate actuating system that local stress variations deviating from those dictated by the predetermined spring ratio control can be achieved in very small areas of the mask. It will be appreciated that a similar arrangement of a gross actuator with separately actuatable stops for each interlinked clamp grouping could be employed with the embodiment of FIG. 31.

To facilitate this more precise stress control, the mask is provided with additional optical sensing apertures 760, in this case fourteen. It should be understood the stretching system illustrated in FIG. 32 has fourteen optical sensors, one for each of these apertures 760, to achieve an appropriate closed loop feed back control (control lines not shown) to the actuators 756 through the respective stretching controls 762, 763, 764 and 765.

Figure 33:
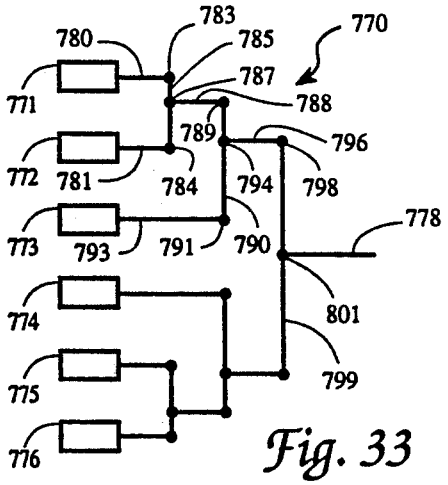
FIG. 33 is a schematic view of another cross bar linkage for the clamping elements on one side of the mask.

FIG. 33 illustrates another wiffle tree linkage 770 for applying a fixed distribution of forces to clamping elements 771, 772, 773, 774, 775 and 776 from an actuator driven rod 778. FIG. 33 of course illustrates a stretching linkage for only one side of the mask and similar systems would be provided for the other sides. The FIG. 33 system is capable of only the fixed force distribution aspect o the present invention described in connection with FIGS. 30, 31 and 3 above and is similar to that described above in connection with FIG. 7.

The linkage 770 will be described with reference to clamping elements 771, 772 and 773 with the understanding that the linkage associated with clamps 774, 775 and 776 is a mirror image thereof. Outwardly extending links 780 and 781 from clamps 771 and 772 ar pivoted at 783 and 784 to cross link 785. The pivotal interconnections at 783 and 784 accommodate movement of the clamps 771 and 772 in a direction perpendicular to the outward links 780 and 781 with the growth of the mask during stretching.

The cross link 785 is pivoted at 787 to a second tier outward link 788 pivoted at its other end 789 to second tier cross link 790. The other end of cross link 790 is pivotally connected at 791 to outward link 793 connected to clamping element 773. Cross link 790 is pivotally connected at 794 to a third tier outward link 796 pivoted at its outer end 798 to third tier cross link 799. Cross link 799 is pivoted centrally at 801 to actuator rod 778.

The offset of pivot 787 provides the fixed distribution of forces between clamps 771 and 772 and the offset of pivot 794 provides the force reduction from clamps 771 and 772 to clamp 773. While specific fixed force distributions have been described with reference to FIG. 7 i.e., specific force ratios, it should be understood that the linkage illustrated in FIG. 7 as well as that illustrated in FIG. 33 are capable of a wide variety of fixed force distributions between the clamping elements.

Figure 34:
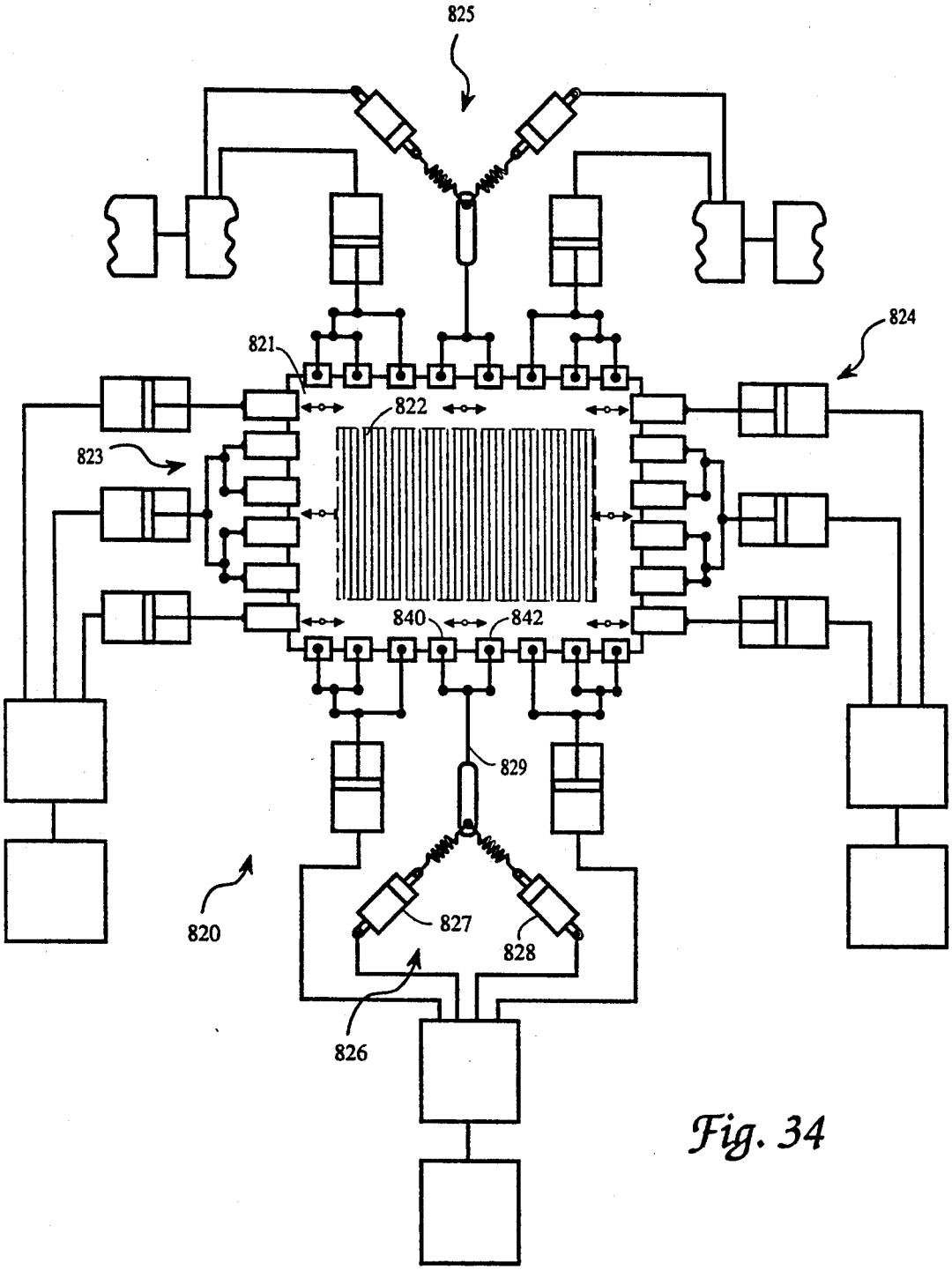
FIG. 34 is a top schematic view similar to FIG. 8*b* showing an arrangement of actuators for applying partly tangential forces to certain clamping elements for a slit aperture mask.

Another stretching system 820 is illustrated in FIG. 34 and this system is particularly, although not exclusively, designed for masks 821 of the type having parallel elongated apertures 822 that extend from one side of the mask to the other as opposed to discrete apertures of the type described with reference to FIGS. 30 to 32 above as well as certain other embodiments described earlier in this application. As is known in the art, the slit-type mask 821 frequently includes narrow horizontal bridges across the slits spaced from one another along the apertures 822 to provide some integrity to the mask principally for mask handling. These bridges however are quite fragile so that stretching along the x axis in the plane in FIG. 34 by side stretching assemblies 823 and 824 must be relatively low.

Figure 8B:
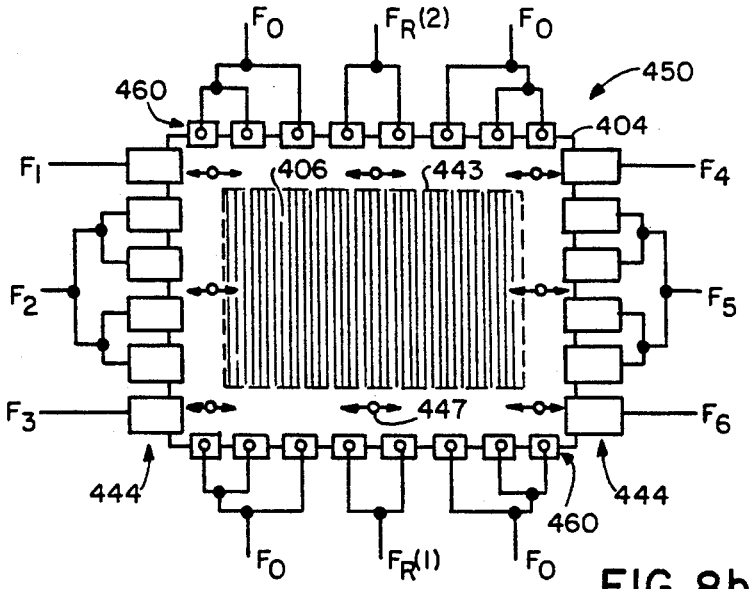
FIG. 8*b* and 8*c* depict a variant of the FIG. 8*a* embodiment which has provision for the application of tangential forces to the edge of a mask.
Figure 8C:
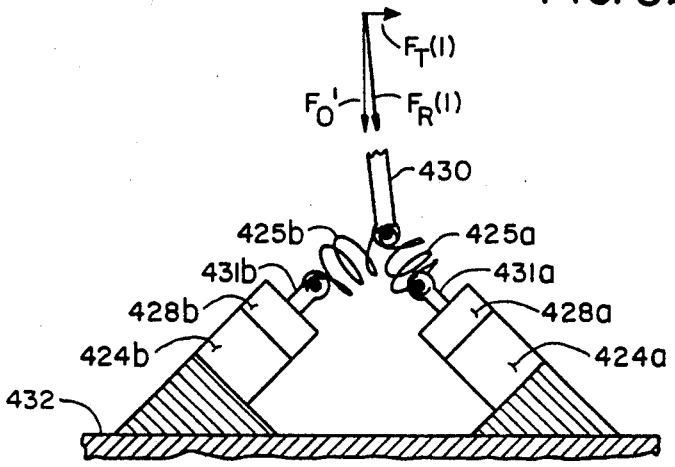

In accordance with the FIG. 34 embodiment and described generally above in connection with the FIG. 8*b* and FIG. 8*c* embodiment, the y axis stretching assemblies 825 and 826 provide y axis stretching as well as significant x axis stretching principally in the central area of the mask. It should be understood however, that other stretching areas of the mask and principally the corner areas of the mask could be provided with tangential stretching components to effect some x axis stretching as well. X axis stretching with tangential (as well as radial) forces on the y axis clamps is effected by stretching the borders instead of stretching directly across the ribs defining the apertures 882 which would occur if x axis stretching were principally provided by the side stretching assemblies 823 and 824.

Clamps 840 and 842 are exemplary of the FIG. 34 system. Stepper motors 827 and 828 are spaced 120 degrees from each other and 120 degrees from link 829. With equal outward displacements of the stepper motors 827 and 828, link 829 applies a pure radial force to clamps 840 and 842. But by the inward displacement of one motor and the outward displacement of the other a net force is applied to link 829 having a tangential component. Even more precise control of tangential forces can be had by providing a separate pair of stepper motors for each clamp for which a tangential component is desired instead of the clamp pair 840, 842.

Figure 35:
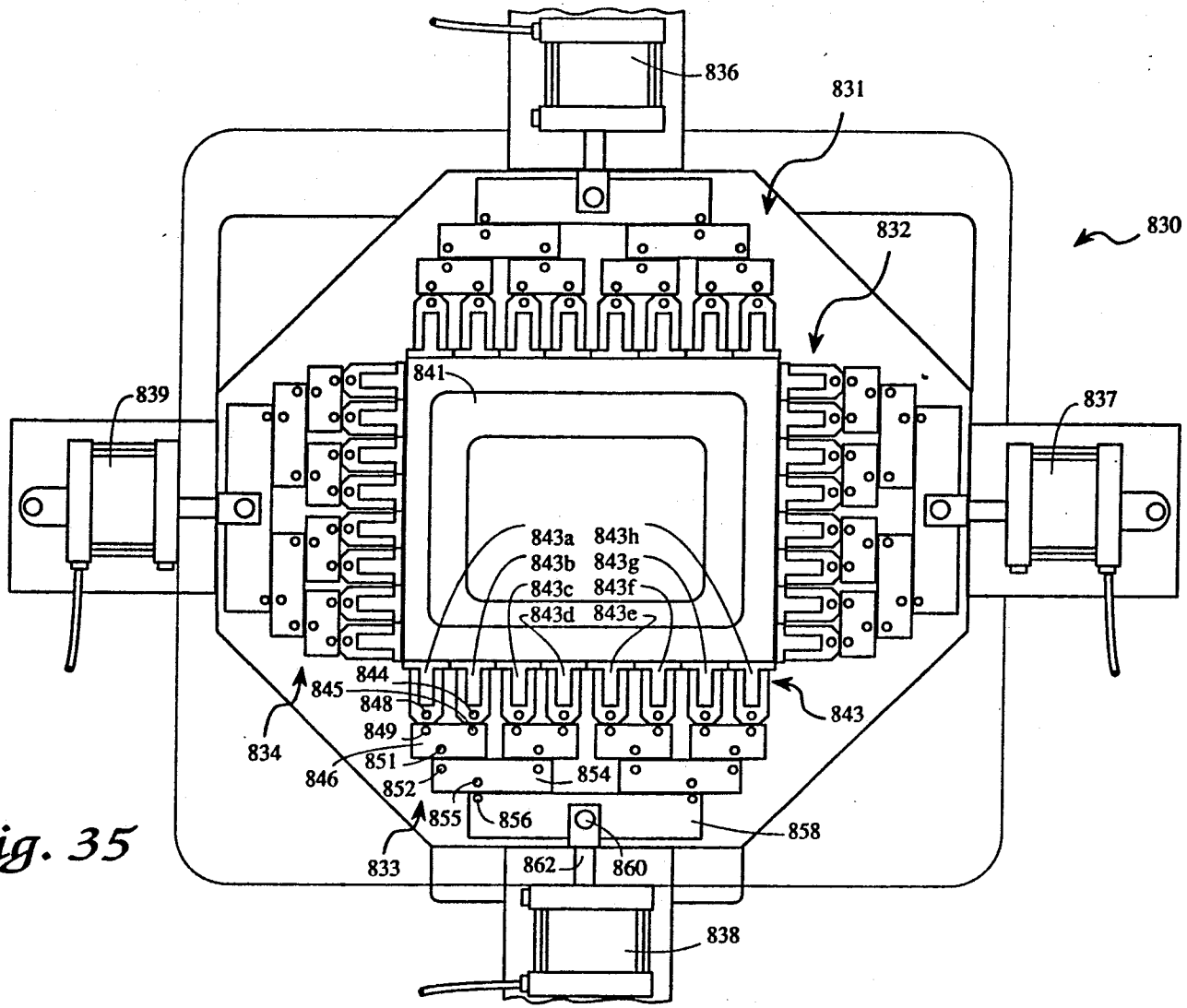
FIG. 35 is a top view of a mask stretching mechanism with eight clamps on each mask side and "wiffle trees" for applying and distributing forces among the clamping and stretching elements.

FIG. 35 illustrates a stretcher assembly with a stretcher platform mounted for x, y and angular movements along with four wiffle tree assemblies for eight clamps along each side of the mask that slide on the platform, and a single independent actuator on each side for effecting movement of the clamps both toward and away from the mask.

Referring to FIG. 35, an improved mask tensioning, deforming, and aligning system 830 is illustrated including four sets of linkage and clamping assemblies 831, 832, 833 and 834. The x axis linkage and clamping assemblies 832 and 834 are identical as are the y axis linkage and clamping assemblies 831 and 833.

Each of the linkage and clamping assemblies 831, 832, 833 and 834 has its own stepper motor 836, 837, 838 and 839 respectively so that "in gross" movement of mask 841 can be achieved in either x or y directions. That is, by displacing actuator 837 (stepper motor) for example, incrementally to the right and at the same time shifting actuator 839 to the right the same incremental distance, mask 841 will move as a whole without varying x axis strain in the mask. The same in gross movements can be effected along the y axis by actuators 836 and 838. Of course, mask stretching control can be also provided in this embodiment for example along the x axis, by either displacing actuators 837 and 839 outwardly from the mask or holding one of the actuators 837 and 839 in place and shifting the other outwardly from the mask. As one will appreciate, each of these movements are different and will produce different mask registrations along the x axis.

Linkage and clamping assembly 833 is seen to include eight clamps 843*a–h*, shown somewhat diagrammatically with the clamp 843*b* pivotally connected at 844 to a radial or outward short link (hidden in the plane of FIG. 35) pivotally connected at point 845 to cross link 846. The adjacent clamp 843*a* is pivotally connected at 848 to a similar short link pivotally connected at its other end at 849 to the same cross link 846.

The cross link 846 is pivotally connected to another short link (also hidden in FIG. 35) at 851 that is pivotally connected at its other end at 852 to a second cross link 854. Note that pivot 851 is offset to achieve the desired ratio of clamping force between the clamps 843*a* and 843*b* discussed above with respect to several of the other embodiments.

Second level cross link 854 is pivotally connected at 855 to another radial short link pivotally connected at its other end at 856 to a single third level cross link 858. Cross link 858 is pivotally connected at 860 to actuator rod 862. Pivot 855 on cross link 854 is offset to the left to provide higher forces to the outer two clamps 843*a* and 843*b* on the left side of mask 841 than to clamps 843*c* and 843*d* also on the lower left quadrant of mask 841.

The remaining clamps 843*e*, 843*f*, 843*g* and 843*h* on the lower right quadrant of mask 841 are driven by actuator 838 through mirror image links to those described above.

FIG. 36 Stretching Assembly With Clamp Guide

Figure 37:
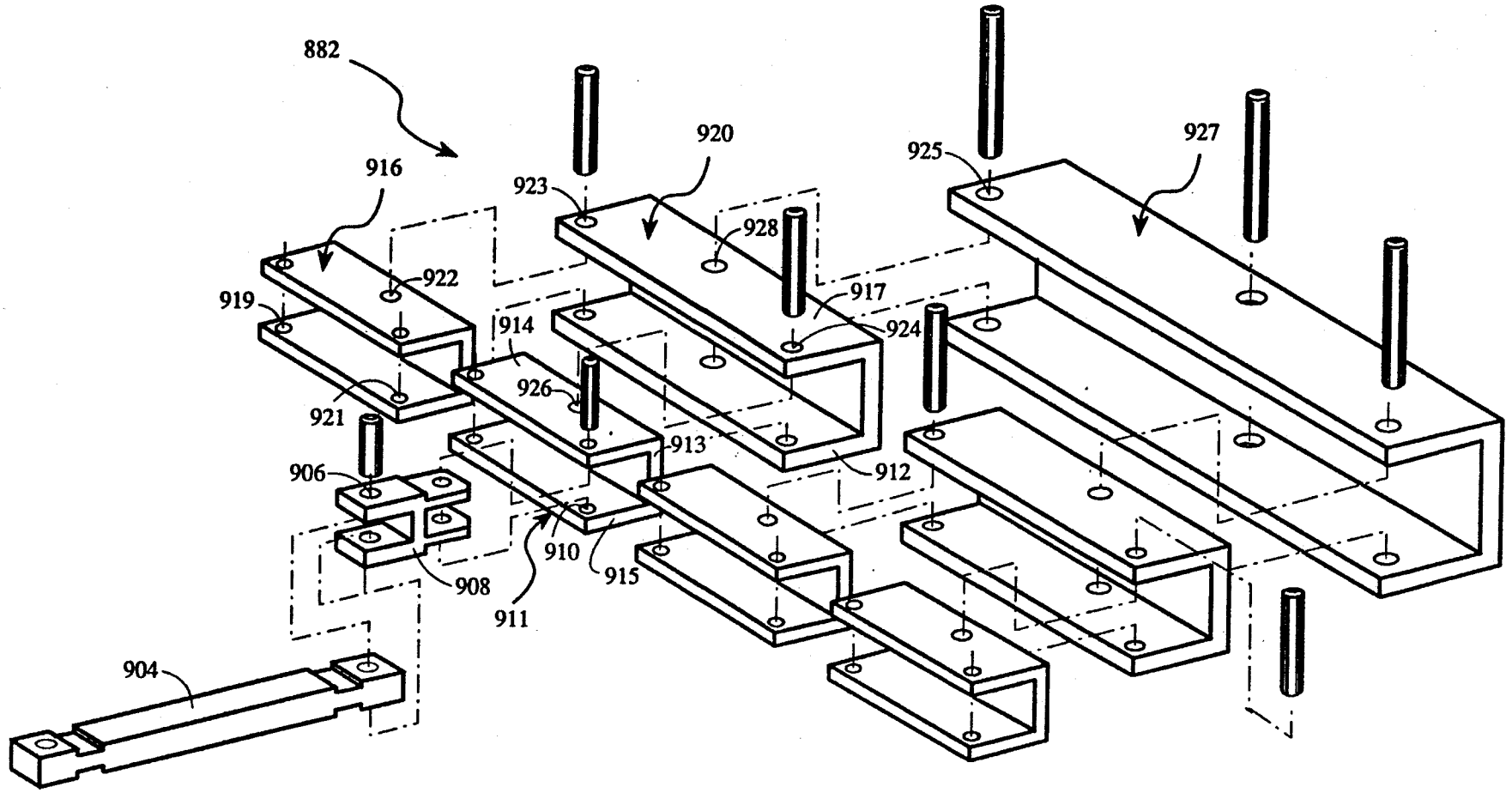
FIG. 37 is an exploded view of an "in line" wiffle tree similar to that illustrated in FIG. 36.

A top view of a stretching assembly 880 is illustrated in FIG. 36 for a single side of a mask and includes an in-line wiffle tree linkage 882 also illustrated generally in FIG. 37 in exploded fashion, and is seen to include a plurality of clamping assemblies 884, only one of which is shown in FIG. 36, and a pusher bar assembly 885 for maintaining alignment of the clamping assemblies 884 as they move toward mask 887.

The movement of the linkage assembly 882 is controlled by a movable frame element 890 which is moved toward and away from mask 887 with the linkage 882 and the clamps 884 by a stepper motor 891. Stepper motor 891 is fixed to a stretcher platform (not shown) that is itself movable by servo motors to effect in gross movement of the mask during registration.

The pusher bar 885 is continuously biased against the clamps 884 and toward the mask 887 by a biasing device 892, which is carried by the movable stretcher frame element 890.

During the advancing, or mask-engagement movement of the clamps 884 toward the mask; described above with reference to FIGS. 26, 27 and 28 above; the stepper motor 891 incrementally "releases" or moves the movable stretcher frame 890 towards the mask 887. At the same time, the biasing device 892 biases the pusher bar 894 toward the mask and against the clamps 884 aligning them in fixed relation to the mask and each other. This releasing and pushing is continued until the clamps 884 reach the mask engaging position illustrated in FIG. 27 above.

The pusher bar has a plurality of U-shape aligning elements 896 having forwardly extending projections 897 and 898 each of which has forward inwardly curved portions 899 that accommodate pivotal movement of the clamping assemblies as the mask 887 grows laterally or in a direction perpendicular to the clamps 884 during stretching.

It should be understood that the aligning elements 896 illustrated in FIG. 36 remain in continuous engagement with a rear projection 901 on each of the clamping assemblies 884, and their primary function is to maintain the clamping assemblies 884 generally parallel, or in fixed relation, to one another as the clamps are moved in together toward and away from the mask in accordance with the clamp advancement and retraction sequence illustrated and described with reference to FIGS. 26 and 29 above.

The in-line linkage assembly 882 illustrated in FIGS. 36 and 37 effects the same general force distribution as the wiffle tree described above with reference to FIG. 35, but it has the additional significant advantage of space conservation because the various pivots of the links are generally in a common vertical plane.

This is achieved as seen in FIG. 37 by providing a plurality of generally horizontal U-shaped links that fit within one another, bearing in mind that only a single clamp link element 904 is illustrated when eight would be provided in the single side stretching assembly 882 shown. As seen in FIG. 37, clamp link 904 is pivotally connected at 906 to a short link 908 internally pivoted at 910 to a first level cross link 911. Cross link 911 is U-shaped having a back wall 913, a top wall 914 and a bottom wall 915. Top wall 914 and bottom wall 915 are sized to just fit within top wall 917 and bottom wall 918 of a second level U-shaped cross link 920.

Cross link 911 has a central pivot 926 connected at 924 to second level cross link 920 so equal forces are applied to the clamps attached to link 911.

Outer cross link 916 has bore pairs 919 and 921 that receive additional clamp links 904 and it has an offset pivot 922 pivotally mounted at 923 to cross link 920. Pivot 922 is offset outwardly to exert a greater force at pivot 919 than at 921.

Second level cross link 920 has an outwardly offset pivot 928 pivotally connected at 925 to a third level U-shaped common cross link 927 so that cross link 916 exerts a greater force on its clamps than cross link 911.

It can be seen in comparing the wiffle tree described with reference to FIG. 35 to that illustrated in FIG. 37, that the U-shaped cross links 911, 916, 920 and 927 shown in FIG. 37 eliminate the need for the short outwardly extending links required in the wiffle tree embodiment illustrated in FIG. 35, and at the same time the "U" shaped configuration provides a much more compact construction. The force distribution capability of the linkage of FIG. 37 is the same as that described above with respect to FIG. 35, as well as some of the other embodiments shown and described above.

While particular embodiments of the invention have been shown and described, it will be readily apparent to those skilled in the art that changes and modifications may be made in the inventive means and method without departing from the invention in its broader aspects, and therefore, the aim of the appended claims is to cover all such changes and modifications as fall within the true spirit and scope of the invention.

What is claimed is:

1. An apparatus for stretching a tension mask having a central area including a plurality of apertures and a surrounding border area, prior to attaching the mask to a support structure on a CRT faceplate, comprising: stretching means for applying a plurality of separate outward forces along the border area, and means for controlling the forces to achieve substantially equal strain across the mask;

the means for applying a plurality of separate forces including:

a plurality of clamping elements along each side of the mask border, a plurality of pivotally mounting links connected to the clamping elements for simultaneously applying stretching forces to the clamping elements and mask including:

a plurality of outwardly extending links each pivotally connected at one end to one of the clamping elements, and a plurality of cross links each pivotally connected to at least two of the outward links; and, means for applying an outward force to at least some of the cross links offset from the center of the cross links whereby different stretching forces will be applied to the clamping elements connected to those cross links.

2. An apparatus for stretching a tension mask including a plurality of apertures and a border area having at least four sides, prior to attaching the mask to a support structure on a CRT, comprising:

a plurality of clamping elements along and engaging the border area sides, means for applying outward stretching forces to each of the clamping elements, and means mounting the clamping elements for lateral movement to accommodate lateral strain in the mask, the means mounting the clamping elements to accommodate lateral strain in the mask including a plurality of outwardly extending links each pivotally connected to one end to one of the clamping elements.

3. The apparatus of claim 2 further comprising:

the clamping elements each including a frame to which the links are pivotally connected, and a clamp engaging the mask in each of the frames.

4. An apparatus for stretching a tension mask having a generally polygonal area including a plurality of apertures and a border area having at least four sides, prior to attaching the mask to a support structure on a CRT, comprising:

a) a plurality of clamping elements along and engaging at least two of the border area sides, b) a plurality of links extending outwardly from the mask each pivotally connected at one end to one of the clamping elements, c) a plurality of cross links each pivotally connected to two of the outwardly extending links, d) a second plurality of links extending outwardly from the mask each pivotally connected at one end to one of the cross links, e) a plurality of second cross links each pivotally connected to two of the second outwardly extending links, f) and means for applying an outward force to the second cross links to effect mask stretching.

5. An apparatus for stretching a tension mask as defined in claim 4, wherein:

the means for applying an outward force to the second cross links includes a common actuator for all the clamping elements on each side of the mask.

6. An apparatus for stretching a tension mask as defined in claim 4, including:

a) a third plurality of links extending outwardly from the mask each pivotally connected at one end to one of the second cross links, and b) a single third cross link pivotally connected to two of the third outwardly extending links, c) and an actuator of the third cross links for straining the mask in at least one direction.

7. An apparatus for stretching a tension mask as defined in claim 4, wherein:

the pivotal connections between the second outwardly extending links and the first cross links are offset from the center of the first cross links to vary the ratio of the outward forces applied to the clamping elements.

8. A system for making a CRT with a flat tension mask mounted on a support structure in the CRT, wherein the mask has a central generally polygonal apertured area and a surrounding border area with at least four sides, comprising:

a) plurality of clamping elements engaging the mask along each of the border sides, b) means for aligning each of the clamps in a predetermined initial position prior to mask clamping, c) and means for engaging all the clamps with the mask border.

9. A system for making a CRT with a flat tension mask as defined in claim 8, wherein:

the means for aligning each of the clamping elements includes a plurality of actuable alignment pins engageable with apertures in each of the clamping elements.

10. A method of stretching a tension mask having a central area including a plurality of apertures and a surrounding border area having sides, prior to attaching the mask to a support structure on a CRT, including the steps of:

a) positioning an untensioned mask in a predetermined fixed position, b) advancing a plurality of clamping elements toward the mask on at least two opposed sides of the mask with the clamping elements open to a position where the edges of the mask on the opposed sides enter the clamping elements, c) aligning the clamping elements in a predetermined position with respect to the mask, d) engaging the clamping elements with the mask while in their predetermined positions, and applying outward forces to the clamping elements to achieve the desired mask stretching.

11. A method of stretching a tension mask as defined in claim 10, wherein:

the step of aligning the clamping elements includes inserting horizontally fixed alignment pins in all the clamping elements.

12. A method of stretching a tension mask as defined in claim 11, further including:

the step of releasing the aligning of the clamping elements by withdrawing the alignment pins from all of the clamping elements.

13. A method of stretching a tension mask as defined in claim 10, wherein:

the step of advancing the clamping elements toward the mask includes: simultaneously advancing the clamping elements of at least one side and maintaining lateral alignment of those clamping elements as they are being advanced.

14. A method of stretching a tension mask as defined in claim 13, wherein:

the step of maintaining lateral alignment includes pushing the clamping elements on each side of the mask with a pusher bar that has recesses each receiving one of the clamping elements.

15. A method of stretching a tension mask as defined in claim 14, wherein:

the step of pushing the clamping elements includes: pushing the clamping elements against a mask engagement movement of a stepper motor attached to the clamping elements, the motor also being utilized to apply the outward forces to the clamping elements.

16. A method of stretching a tension mask as defined in claim 10, wherein:

the step of positioning an untensioned mask includes inserting alignment pins through apertures in the mask, and after clamping element engagement with the mask and before applying the outward forces to the mask, withdrawing the mask alignment pins.

17. A method of stretching a tension mask as defined in claim 10, wherein:

the step of positioning the mask includes positioning the mask on a lower platen with the edges of the mask overhanging the platen to facilitate clamp entry.

18. A method of stretching a tension mask as defined in claim 17, wherein:

the step of positioning the mask includes engaging the mask with an upper platen, and prior to applying the outward forces to clamping elements releasing the upper platen from the mask.

19. A method of stretching a tension mask having a central area including a plurality of apertures and a surrounding border area having sides, prior to attaching the mask to a support structure on a CRT, including the steps of:

a) positioning an untensioned mask in a predetermined fixed position, b) engaging a plurality of clamping elements on all sides of the mask, and c) applying outward forces to all of the clamping elements on all sides of the mask while d) permitting movement of the clamping elements in a direction generally perpendicular to the outward forces to accommodate lateral maskstrain; the outward forces on at least some of said clamping elements having a direction angular to the major axes of the mask.

20. A method of stretching a tension mask having a central area including a plurality of apertures and a surrounding border area having sides, prior to attaching the mask to a support structure on a CRT, including the steps of:

a) positioning an untensioned mask in a predetermined fixed position and, b) simultaneously applying outward forces to clamping elements attached to the mask, at least some of the outward forces being independently controlled from others to accommodate variations in mask and screen configurations not necessarily common to all masks.

21. A method of stretching a tension mask as defined in claim 20, wherein:

each of the outward forces is independently controlled.

22. A method of stretching a tension mask having a central area with elongated slit apertures parallel to one another surrounded by a border area on all sides of the mask, prior to attaching the mask to a support structure on a CRT, including the steps of:

a) positioning an untensioned mask in a predetermined fixed position, b) engaging a plurality of clamping elements with the mask on each of first opposed borders of the mask that are perpendicular with the slit apertures, and c) applying a plurality of generally outward forces to the clamping elements with at least some of the forces having components parallel to the first opposed borders so that bi-directional stretching is achieved without high forces being applied to second opposed borders of the mask parallel with the slit apertures.

23. A method of stretching a slit tension mask as defined in claim 22, including:

a) engaging a plurality of clamping elements with the second opposed borders of the mask, b) applying substantially lower outward forces to the second opposed border clamping elements than to the first opposed border clamping elements to avoid slit aperture distortion.

24. A method of stretching a tension mask as defined in claim 22, wherein:

the outward forces having components parallel to first opposed borders of the mask are applied only to the clamping elements near the middle of the first opposed borders of the mask.

25. A method of stretching a tension mask having a central area including a plurality of apertures and a surrounding border area having sides, prior to attaching the mask to a support structure on a CRT, including the steps of:

a) positioning an untensioned mask in a predetermined fixed position, b) engaging a plurality of clamping elements along at least two opposed sides of the mask and, c) applying generally outward forces to the clamping elements having a predetermined fixed ratio to one another with the highest forces at the corners of the mask.

26. A method of stretching a tension mask as defined in claim 25, wherein the step of applying outward forces having a predetermined fixed ratio is effected by a plurality of cross links immediately adjacent pairs of clamping elements with the application of outward forces to the clamping elements being offset from the middle of the cross links.

27. The method of claim 25 including:

applying about 1.7 times as much outward force to the clamping elements at the mask corners as the force applied to the clamping elements near the center of the central apertured mask area.

28. A method of stretching a tension mask as defined in claim 25, wherein:

the step of applying outward forces having a predetermined fixed ratio is effected by a plurality of springs having predetermined fixed ratios of spring rates.

29. A method of stretching a tension mask as defined in claim 25, wherein:

the outward forces are applied by a plurality of independent actuators.

30. An apparatus for stretching a tension mask having a central area including a plurality of apertures and a surrounding border area, prior to attaching the mask to a support structure on a CRT faceplate, comprising: means for applying a plurality of separate outward forces along the border area, and means for controlling the forces to achieve substantially equal strain across the mask;

the means for applying a plurality of separate forces including:

a plurality of clamping elements along each side of the mask border connected to a common actuator through a plurality of springs for simultaneously applying stretching forces to the clamping elements and mask; and the means for controlling the forces including a plurality of separately actuatable stops for variable positioning of the clamping elements.

* * * * *